US010545523B1

(12) United States Patent
Wu et al.

(10) Patent No.: US 10,545,523 B1
(45) Date of Patent: Jan. 28, 2020

(54) ADAPTIVE GATE-BIASED FIELD EFFECT TRANSISTOR FOR LOW-DROPOUT REGULATOR

(71) Applicant: QUALCOMM Incorporated, San Diego, CA (US)

(72) Inventors: Zhengzheng Wu, Santa Clara, CA (US); Chao Song, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/170,700

(22) Filed: Oct. 25, 2018

(51) Int. Cl.
*G05F 1/595* (2006.01)
*G05F 1/575* (2006.01)

(52) U.S. Cl.
CPC ..... *G05F 1/595* (2013.01); *G05F 1/575* (2013.01)

(58) Field of Classification Search
CPC . G05F 1/46; G05F 1/462; G05F 1/461; G05F 1/56; G05F 1/575; G05F 1/595; G05F 1/625
See application file for complete search history.

(56) References Cited

U.S. PATENT DOCUMENTS

| | | | |
|---|---|---|---|
| 5,631,598 | A | 5/1997 | Miranda et al. |
| 6,046,577 | A | 4/2000 | Rincon-Mora et al. |
| 6,147,550 | A | 11/2000 | Holloway |
| 6,188,211 | B1 | 2/2001 | Rincon-Mora et al. |
| 6,188,212 | B1 | 2/2001 | Larson et al. |
| 6,359,427 | B1 | 3/2002 | Edwards et al. |
| 6,522,111 | B2 | 2/2003 | Zadeh et al. |
| 6,586,917 | B1 | 7/2003 | Smith |
| 6,617,832 | B1 | 9/2003 | Kobayashi |
| 6,791,390 | B2 | 9/2004 | Gay |
| 6,856,124 | B2 | 2/2005 | Dearn et al. |
| 7,109,690 | B2 | 9/2006 | Ke et al. |
| 7,148,670 | B2 | 12/2006 | Inn et al. |
| 7,492,137 | B2 | 2/2009 | Yamada |
| 7,504,814 | B2 | 3/2009 | Lee et al. |

(Continued)

FOREIGN PATENT DOCUMENTS

| | | | |
|---|---|---|---|
| CN | 1175018 | A | 3/1998 |
| CN | 101419477 | A | 4/2009 |

(Continued)

OTHER PUBLICATIONS

Akhamal H., et al., "Fast Transient Response Low Drop-out Voltage Regulator," International Journal of Embedded Systems and Applications (IJESA), Sep. 2014, vol. 4, No. 2/3, pp. 1-10.

(Continued)

*Primary Examiner* — Adolf D Berhane
(74) *Attorney, Agent, or Firm* — Loza & Loza, LLP/Qualcomm

(57) ABSTRACT

A load circuit of a low-dropout (LDO) regulator is disclosed herein according to certain aspects. The load circuit includes a field effect transistor having a source coupled to a supply rail, a gate, and a drain coupled to a gate of a pass transistor of the LDO regulator. The load circuit also includes an adjustable voltage source coupled between the drain and the gate of the field effect transistor, and a voltage control circuit configured to detect a change in a current load through the pass transistor, and to adjust a voltage of the adjustable voltage source based on the detected change in the current load.

21 Claims, 14 Drawing Sheets

(56) References Cited

U.S. PATENT DOCUMENTS

| | | | | |
|---|---|---|---|---|
| 7,548,051 | B1 | 6/2009 | Tenbroek et al. | |
| 7,710,090 | B1 | 5/2010 | Kimura | |
| 8,072,196 | B1 | 12/2011 | Li | |
| 8,248,150 | B2 | 8/2012 | Tadeparthy et al. | |
| 8,294,441 | B2 | 10/2012 | Gurcan et al. | |
| 8,841,893 | B2 | 9/2014 | Bulzacchelli et al. | |
| 9,223,329 | B2 | 12/2015 | Pulvirenti et al. | |
| 9,274,534 | B2 | 3/2016 | Fang et al. | |
| 9,377,798 | B2 | 6/2016 | Bhattad | |
| 9,543,826 | B2 | 1/2017 | Chen et al. | |
| 9,588,541 | B1 | 3/2017 | Ho et al. | |
| 9,608,522 | B2 | 3/2017 | Lin et al. | |
| 9,684,325 | B1 | 6/2017 | Rasmus | |
| 9,740,225 | B1 | 8/2017 | Wong | |
| 9,778,672 | B1 | 10/2017 | Gao et al. | |
| 9,946,283 | B1 | 4/2018 | Yung et al. | |
| 10,013,005 | B1 | 7/2018 | Ippili | |
| 10,411,599 | B1 | 9/2019 | Shi et al. | |
| 10,444,780 | B1 | 10/2019 | Cheng et al. | |
| 2004/0027097 | A1 | 2/2004 | Denicholas et al. | |
| 2004/0140845 | A1 | 7/2004 | Eberlein | |
| 2005/0189930 | A1 | 9/2005 | Wu et al. | |
| 2005/0206444 | A1 | 9/2005 | Perez et al. | |
| 2005/0248331 | A1 | 11/2005 | Whittaker | |
| 2006/0164053 | A1 | 7/2006 | Walter et al. | |
| 2006/0181258 | A1 | 8/2006 | Benbrik | |
| 2007/0057655 | A1 | 3/2007 | Nishida | |
| 2007/0139030 | A1 | 6/2007 | Lee et al. | |
| 2007/0242536 | A1 | 10/2007 | Matsubara | |
| 2008/0211467 | A1 | 9/2008 | Huang et al. | |
| 2008/0278127 | A1 | 11/2008 | Nagata | |
| 2008/0303496 | A1 | 12/2008 | Schlueter et al. | |
| 2009/0010035 | A1 | 1/2009 | Williams | |
| 2009/0179622 | A1 | 7/2009 | Ivanov et al. | |
| 2009/0189591 | A1 | 7/2009 | Sperling et al. | |
| 2009/0243568 | A1 | 10/2009 | Nguyen | |
| 2009/0322429 | A1 | 12/2009 | Ivanov et al. | |
| 2010/0213917 | A1 | 8/2010 | Pulijala et al. | |
| 2010/0327959 | A1 | 12/2010 | Lee | |
| 2011/0089916 | A1 | 4/2011 | Soenen et al. | |
| 2012/0112718 | A1* | 5/2012 | Pons | G05F 1/575 323/281 |
| 2012/0187897 | A1 | 7/2012 | Lenk et al. | |
| 2012/0229111 | A1 | 9/2012 | Serdarevic | |
| 2013/0082671 | A1 | 4/2013 | Ivanov et al. | |
| 2013/0099764 | A1 | 4/2013 | Zhang et al. | |
| 2013/0113447 | A1 | 5/2013 | Kadanka | |
| 2013/0221940 | A1 | 8/2013 | Yan et al. | |
| 2014/0042998 | A1* | 2/2014 | Saito | G05F 1/468 323/271 |
| 2014/0084896 | A1 | 3/2014 | Zhang et al. | |
| 2014/0139198 | A1 | 5/2014 | Manlove et al. | |
| 2014/0266103 | A1 | 9/2014 | Wang et al. | |
| 2014/0277812 | A1 | 9/2014 | Shih et al. | |
| 2014/0306676 | A1 | 10/2014 | Hu et al. | |
| 2015/0028828 | A1 | 1/2015 | Chen | |
| 2015/0103566 | A1 | 4/2015 | Keogh et al. | |
| 2015/0115830 | A1* | 4/2015 | Siessegger | H05B 33/0803 315/291 |
| 2015/0130434 | A1 | 5/2015 | Jain et al. | |
| 2015/0137780 | A1* | 5/2015 | Lerner | G05F 1/56 323/280 |
| 2015/0160668 | A1 | 6/2015 | Pujol et al. | |
| 2015/0168969 | A1 | 6/2015 | Shor | |
| 2015/0192943 | A1 | 7/2015 | Roham et al. | |
| 2015/0198959 | A1 | 7/2015 | Kuttner | |
| 2015/0198960 | A1 | 7/2015 | Zhang et al. | |
| 2015/0220096 | A1 | 8/2015 | Luff | |
| 2015/0349622 | A1 | 12/2015 | Lo et al. | |
| 2015/0362936 | A1 | 12/2015 | Patel et al. | |
| 2016/0124448 | A1 | 5/2016 | Murukumpet et al. | |
| 2016/0349776 | A1 | 12/2016 | Conte et al. | |
| 2017/0052552 | A1 | 2/2017 | Mahmoudi et al. | |
| 2017/0117803 | A1* | 4/2017 | Matsuki | H02M 3/156 |
| 2017/0205841 | A1 | 7/2017 | Jefremow et al. | |
| 2017/0212540 | A1 | 7/2017 | Cho et al. | |
| 2017/0220059 | A1* | 8/2017 | Kadowaki | G05F 1/575 |
| 2017/0322575 | A1 | 11/2017 | Du et al. | |
| 2017/0364110 | A1 | 12/2017 | Golara et al. | |
| 2017/0371365 | A1* | 12/2017 | Kossel | G05F 1/575 |
| 2018/0217623 | A1* | 8/2018 | Bhattad | G05F 1/595 |
| 2019/0146532 | A1* | 5/2019 | Ballarin | G05F 1/575 |

FOREIGN PATENT DOCUMENTS

| | | | |
|---|---|---|---|
| CN | 102043417 | A | 5/2011 |
| CN | 203745939 | U | 7/2014 |
| CN | 108445950 | A | 8/2018 |
| EP | 1253498 | A1 | 10/2002 |
| WO | 2014042726 | A1 | 3/2014 |

OTHER PUBLICATIONS

Alon E., et al., "Replica Compensated Linear Regulators for Supply-Regulated Phase-Locked Loops," IEEE Journal of Solid-State Circuits, vol. 41, No. 2, Feb. 2006, pp. 413-424.

Assi A., et al., "A Fully Differential and Tunable CMOS Current Mode opamp Based on Transimpedance-Transconductance Technique" , Circuits and Systems, 1997. Proceedings of the 40th Midwest Symposium on Sacramento, CA, USA Aug. 3-6, 1997, New York, NY, USA, IEEE, US, vol. 1, Aug. 3, 1997 (Aug. 3, 1997), pp. 168-171, XP010272437, DOI: 10.1109/MWSCAS.1997.666060, ISBN: 978-0-7803-3694-0.

Bontempo G., et al., "Low Supply Voltage, Low Quiescent Current, ULDO Linear Regulator," The 8th IEEE International Conference on Electronics, Circuits and Systems 2001, pp. 409-412.

Bulzacchelli J.F., et al., "Dual-Loop System of Distributed Microregulators With High DC Accuracy, Load Response Time Below 500 ps, and 85-mV Dropout Voltage," IEEE Journal of Solid-State Circuits, vol. 47, No. 4, Apr. 2012, pp. 863-874.

Camacho D., et al., "An NMOS Low Dropout Voltage Regulator with Switched Floating Capacitor Gate Overdrive," Department of Electrical Engineering, Southern Methodist University, Dallas, Texas, USA, 52nd IEEE International Midwest Symposium on Circuits and Systems, Aug. 2009, pp. 808-811.

Den Besten G.W., et al., "Embedded 5 V-to-33 V Voltage Regulator for Supplying Digital IC's in 3.3 V CMOS Technology," IEEE Journal of Solid-State Circuits, vol. 33, No. 7, Jul. 1998, pp. 956-962.

Gupta V., et al., "A Low Dropout, CMOS Regulator with High PSR over Wideband Frequencies", IEEE International Symposium on Circuits and Systems, May 2005, pp. 4245-4248.

Hazucha P., et al., "Area-Efficient Linear Regulator With Ultra-Fast Load Regulation", IEEE Journal of Solid-State Circuits, vol. 40, No. 4, Apr. 2005, pp. 933-940.

Huang H.Y., et al., "A Wideband CMOS Transconductance-Transimpedance Amplifier", Midwest Symposium on Circuits and Systems. Cairo, Egypt, Dec. 27-30, 2003; [Midwest Symposium on Circuits and Systems], Piscataway, NJ, IEEE, US, vol. 1, Dec. 27, 2003 (Dec. 27, 2003), pp. 153-156, XP010867413, DOI: 10.1109/MWSCAS.2003.1562241, ISBN: 978-0-7803-8294-7.

Lu Y., et al., "A 0.65ns-Response-Time 3.01ps FOM Fully-Integrated Low-Dropout Regulator with Full-Spectrum Power-Supply—Rejection for Wideband Communication Systems," IEEE International Solid-State Circuits Conference, Technical Papers, Feb. 2014, pp. 306-307. Retrieved from the Internet: URL:http://www.researchgate.net/publication/271550565.

Milliken R.J., et al., "Full on-chip CMOS low-dropout voltage regulator", IEEE Transactions on Circuits and Systems I: Fundamental Theory and Applications, vol. 54, No. 9, Sep. 2007, pp. 1879-1890.

Rincon-Mora G.A., et al., "A Low-Voltage, Low Quiescent Current, Low Drop-Out Regulator," IEEE Journal of Solid-State Circuits, Jan. 1998, vol. 33, No. 1, pp. 36-44.

(56) References Cited

OTHER PUBLICATIONS

Teel J.C., "Understanding power supply ripple rejection in linear regulators", Analog Applications Journal, Analog and Mixed-Signal Products, 2005, 4 Pages.

* cited by examiner

ADAPTIVE GATE-BIASED FIELD EFFECT TRANSISTOR FOR LOW-DROPOUT REGULATOR

BACKGROUND

Field

Aspects of the present disclosure relate generally to voltage regulators, and more particularly, to low-dropout (LDO) regulators.

Background

Voltage regulators are used in a variety of systems to provide regulated voltages to power circuits in the systems. A commonly used voltage regulator is a low-dropout (LDO) regulator. An LDO regulator typically includes a pass transistor and an amplifier coupled in a feedback loop to provide a regulated voltage from a supply voltage.

SUMMARY

The following presents a simplified summary of one or more implementations in order to provide a basic understanding of such implementations. This summary is not an extensive overview of all contemplated implementations and is intended to neither identify key or critical elements of all implementations nor delineate the scope of any or all implementations. Its sole purpose is to present some concepts of one or more implementations in a simplified form as a prelude to the more detailed description that is presented later.

A first aspect relates to a load circuit of a low-dropout (LDO) regulator. The load circuit includes a field effect transistor having a source coupled to a supply rail, a gate, and a drain coupled to a gate of a pass transistor of the LDO regulator. The load circuit also includes an adjustable voltage source coupled between the drain and the gate of the field effect transistor, and a voltage control circuit configured to detect a change in a current load through the pass transistor, and to adjust a voltage of the adjustable voltage source based on the detected change in the current load.

A second aspect relates to a method of voltage regulation. The method includes regulating a voltage using a low-dropout (LDO) regulator, wherein the LDO regulator includes a pass transistor, and a field effect transistor having a source coupled to a supply rail, a gate, and a drain coupled to a gate of the pass transistor. The method also includes detecting a change in a current load through the pass transistor, and adjusting a drain-to-gate voltage of the field effect transistor based on the detected change in the current load.

A third aspect relates to a low-dropout (LDO) regulator. The LDO regulator includes a pass transistor having a source coupled to a supply rail, a gate, and a drain coupled to an output of the LDO regulator. The LDO regulator also includes an amplifier having an output and an input, wherein the input of the amplifier is coupled to the output of the LDO regulator via a feedback path. The LDO regulator further includes a first switch between the output of the amplifier and the gate of the pass transistor, and a second switch between the gate of the pass transistor and a ground.

To the accomplishment of the foregoing and related ends, the one or more implementations include the features hereinafter fully described and particularly pointed out in the claims. The following description and the annexed drawings set forth in detail certain illustrative aspects of the one or more implementations. These aspects are indicative, however, of but a few of the various ways in which the principles of various implementations may be employed and the described implementations are intended to include all such aspects and their equivalents.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Figure 1:
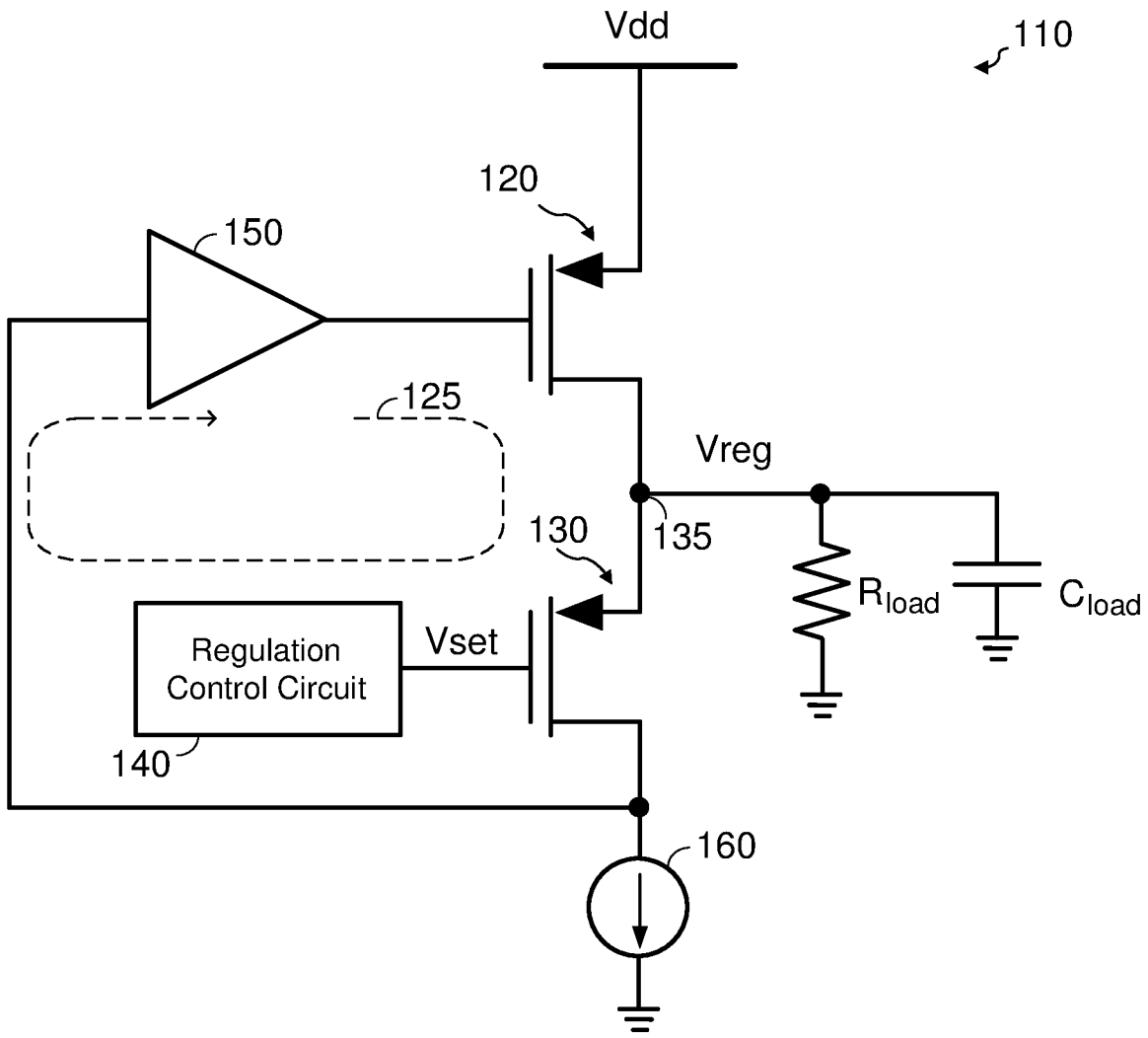
FIG. 1 shows an example of a low-dropout (LDO) regulator according to certain aspects of the present disclosure.

FIG. 1 shows an example of a low-dropout (LDO) regulator 110 according to certain aspects of the present disclosure. The LDO regulator 110 is configured to provide a regulated voltage Vreg at an output 135. In FIG. 1, the resistive load and the capacitive load at the output 135 of the LDO regulator 110 are depicted as a load resistor $R_{load}$ and a load capacitor $C_{load}$, respectively, coupled to the output 135.

The LDO regulator 110 includes a pass transistor 120 configured to deliver current from a supply rail Vdd to a circuit (not shown) coupled to the output 135. The circuit may include one or more analog circuits, one or more digital circuits, or both. In the example in FIG. 1, the pass transistor 120 is implemented with a p-type field effect transistor (PFET) to provide a low dropout voltage, in which the source of the pass transistor 120 is coupled to the supply rail Vdd, and the drain of the pass transistor 120 is coupled to the output 135.

The LDO regulator 110 also includes a transistor 130, a regulation control circuit 140 driving the transistor 130, an amplifier 150, and a current source 160. The transistor 130 is coupled with the amplifier 150 in a feedback loop 125 that adjusts the gate voltage of the pass transistor 120 to maintain the regulated voltage Vreg at approximately a desired voltage under current load changes. The transistor 130 sets the regulated voltage Vreg based on a set voltage Vset input to the gate of the transistor 130, as discussed further below.

In the example in FIG. 1, the transistor 130 is implemented with a PFET having a source coupled to the output 135 and a drain coupled to the current source 160. The current source 160 is coupled between the drain of the transistor 130 and ground, and is configured to provide a bias current. The regulation control circuit 140 is configured to set the set voltage Vset of the transistor 130 such that the regulated voltage Vreg is at approximately the desired voltage, as discussed further below. The transistor 130 and the amplifier 150 are used to form the feedback loop 125 with the pass transistor 120, providing the loop gain for the output stage of the LDO regulator 110. The output stage of the LDO regulator 110 drives current to the circuit (not shown) at the output 135. The input of the amplifier 150 is coupled to the drain of the transistor 130 and the output of the amplifier 150 is coupled to the gate of the pass transistor 120.

Figure 2:
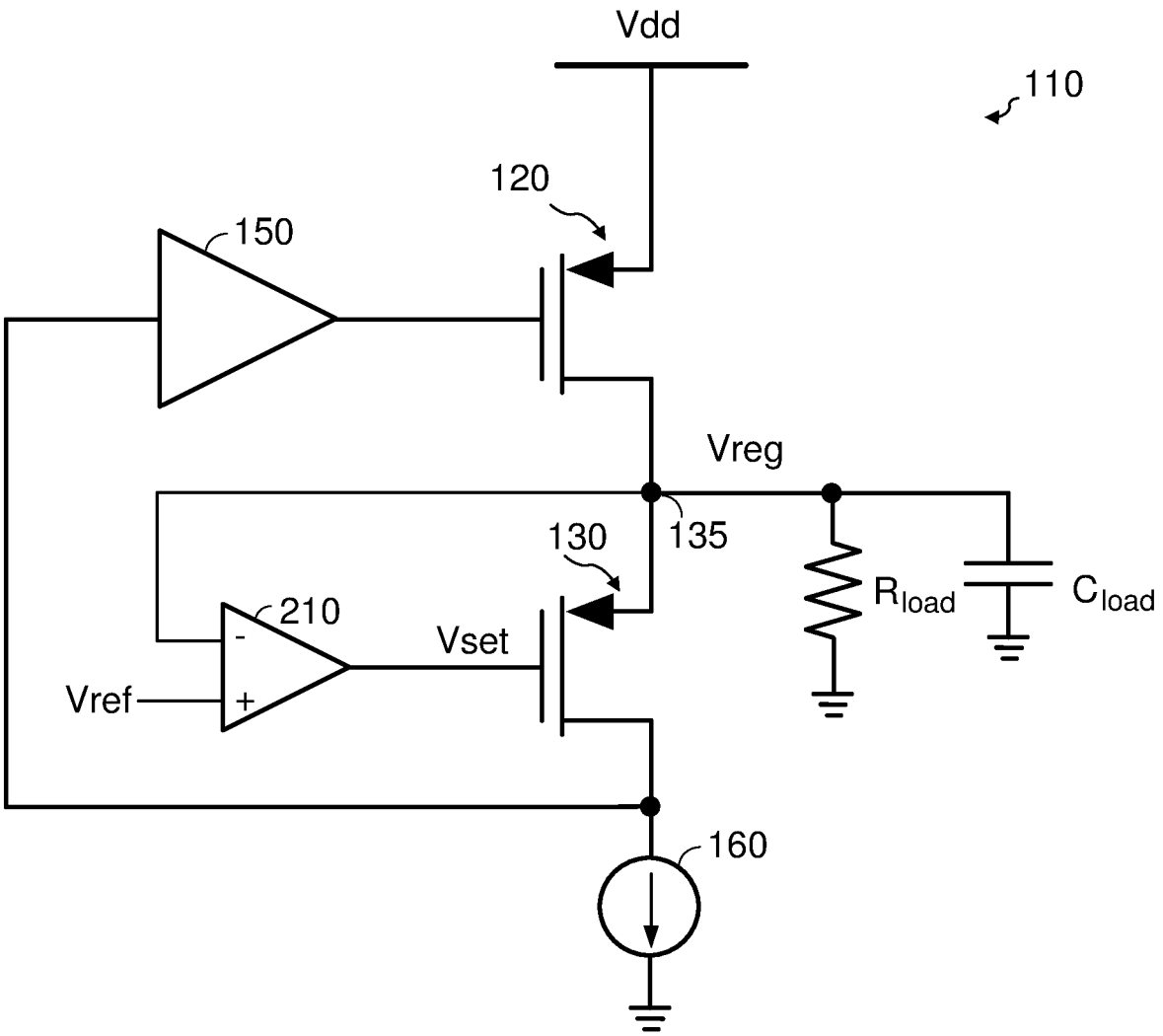
FIG. 2 shows an exemplary implementation of a regulation control circuit according to certain aspects of the present disclosure.

The regulation control circuit 140 may be implemented with an error amplifier, a replica-bias circuit, or another type of circuit known in the art. In this regard, FIG. 2 shows an example in which the regulation control circuit 140 in FIG. 1 is implemented with an error amplifier 210. In this example, the regulated voltage Vreg at the output 135 is input to the negative input of the error amplifier 210, and a reference voltage Vref is input to the positive input of the error amplifier 210. The output of the error amplifier 210 is coupled to the gate of the transistor 130. Thus, in this example, the output of the error amplifier 210 provides the set voltage Vset of the transistor 130. From the perspective of the error amplifier 210, the transistor 130 behaves as a flipped source follower transistor, in which the source voltage of the transistor 130 is approximately equal to Vset plus the source-to-gate voltage of the transistor 130. Note that the feedback loop 125 of the output stage is not labeled in FIG. 2 for ease of illustration.

In operation, the error amplifier 210 sets the set voltage Vset of the transistor 130 based on the reference voltage Vref and the regulated voltage Vreg such that the regulated voltage Vreg is at approximately the reference voltage Vref. Thus, in this example, the regulated voltage Vreg may be set to a desired voltage by setting the reference voltage Vref to the desired voltage. In this example, the error amplifier 210 sets the DC operating point (steady-state operating condition) of the regulated voltage Vreg at approximately the reference voltage Vref. The feedback loop 125 provides fast corrections for changes in the regulated voltage Vreg due to changes in current load conditions.

Although FIG. 2 shows an example in which the regulated voltage Vreg is input directly to the negative input of the error amplifier 210, it is to be appreciated that this need not be the case. It is to be appreciated that the regulation control circuit 140 is not limited to the exemplary implementation shown in FIG. 2, and that the regulation control circuit 140 may be implemented with a replica-bias circuit or another type of circuit, as mentioned above.

Figure 3:
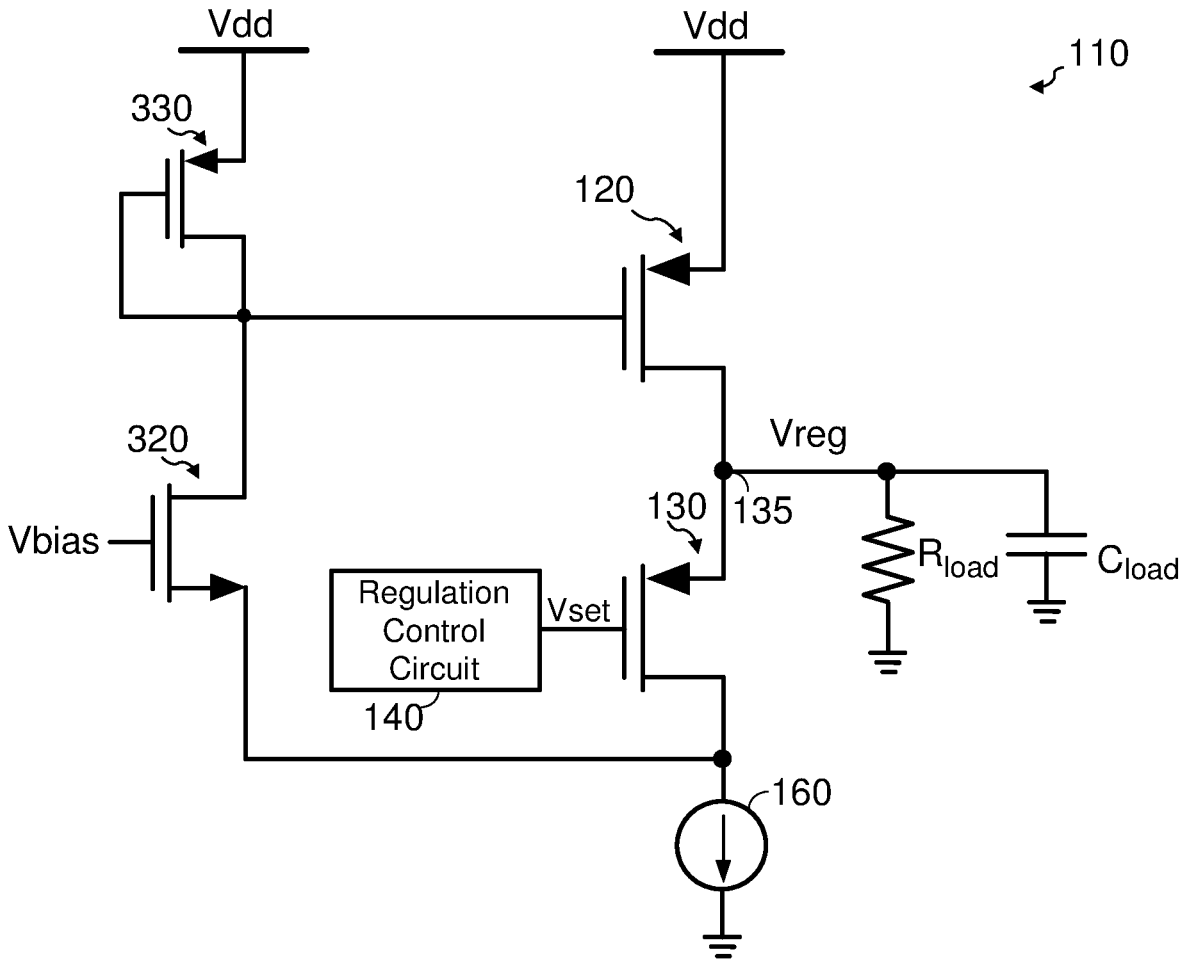
FIG. 3 shows an example of an LDO regulator including a common-gate amplifier and a diode-connected field effect transistor (FET) load according to certain aspects of the present disclosure.

FIG. 3 shows an example in which the amplifier 150 shown in FIG. 1 is implemented with a common-gate amplifier 320 and a diode-connected FET 330. In the example in FIG. 3, the common-gate amplifier 320 is implemented with an n-type field effect transistor (NFET) 320, in which the source of the NFET is coupled to the drain of the transistor 130 in a folded cascode configuration, the drain of the NFET is coupled to the gate of the pass transistor 120, and the gate of the NFET is biased with a DC bias voltage Vbias. In this example, the input of the common-gate amplifier 320 is located at the source of the NFET and the output of the common-gate amplifier 320 is located at the drain of the NFET. From the perspective of the feedback loop 125, the transistor 130 behaves as a common-gate amplifier. This is because the feedback 125 loop has a much faster response than the error amplifier 210 such that Vset appears as an approximately DC voltage at the gate of the transistor 130.

The diode-connected FET 330 is used as a load for the common-gate amplifier 320. In the example in FIG. 3, the diode-connected FET 330 is implemented with a PFET, in which the source of the diode-connected FET 330 is coupled to the supply rail Vdd, and the drain of the diode-connected FET 330 is coupled to a node between the gate of the pass transistor 120 and the output of the common-gate amplifier 320. The gate of the diode-connected FET 330 is tied to the drain of the diode-connected FET 330, as shown in FIG. 3. As a result, the gate of the diode-connected FET 330 is coupled to the gate of the pass transistor 120. This causes the source-to-gate voltage $V_{SG_D}$ of the diode-connected FET 330 to track the source-to-gate voltage $V_{SG_P}$ of the pass transistor 120, as discussed further below.

In this example, the feedback loop 125 has a fast response time, enabling the LDO regulator 110 to quickly respond to changes in the current load. The quick response reduces the magnitude of voltage overshoots and/or undershoots on the regulated voltage Vreg when the current load changes.

Also, the LDO regulator 110 in this example is able to operate with a low supply voltage for reduced power consumption. For example, the LDO regulator 110 may support a minimum supply voltage of less than 2Vt, where Vt is the threshold voltage of a transistor. The low supply voltage allows the LDO regulator 110 to provide a low regulated voltage Vreg at the output 135 with low headroom loss to power the circuit coupled to the output 135. The low regulated voltage Vreg allows the circuit to be implemented with high density, thin-oxide transistors instead of larger thick-oxide transistors to reduce the chip area of the circuit.

However, using the diode-connected FET 330 as the load for the common-gate amplifier 320 may limit the loop stability of the LDO regulator 110 to a narrow range of current load conditions, which may make the LDO regulator 110 unsuitable for applications requiring voltage regulation over a large range of current loads. For example, stability over a large current load range may be desirable in cases where power down and/or power up of the circuit coupled to the LDO regulator 110 results in large changes in the current load. In another example, stability over a large current load range may be desirable in cases where the circuit coupled to the LDO regulator 110 changes operating frequencies, resulting in a large change in the current load. In yet another example, stability over a large current load range may be desirable for the case of a digital circuit coupled to the LDO regulator 110, in which on/off switching of the digital circuit results in large changes in the current load.

The loop stability of the LDO regulator 110 in FIG. 3 as a function of current load will now be discussed according to certain aspects. The phase margin of the LDO regulator 110 is a function of a non-dominate pole of the feedback loop 125 given by:

$$\text{non-dominate pole}=gm_D/C_{Gpass} \quad (1)$$

where $gm_D$ is the transconductance of the diode-connected FET 330 and $C_{Gpass}$ is the gate capacitance of the pass transistor 120. The dominate pole of the feedback loop 125 of the output stage is a function of the load capacitance $C_{load}$, in which the load capacitance $C_{load}$ may be used for stability compensation and supply noise filtering.

The transconductance $gm_D$ of the diode-connected FET 330 is a function of the source-to-gate voltage $V_{SG_D}$ of the diode-connected FET 330. Since the source-to-gate voltage $V_{SG_D}$ of the diode-connected FET 330 tracks the source-to-gate voltage $V_{SG_P}$ of the pass transistor 120, the transconductance $gm_D$ of the diode-connected FET 330 is a function of the source-to-gate voltage $V_{SG_P}$ of the pass transistor 120. The source-to-gate voltage $V_{SG_P}$ of the pass transistor 120 is a function of the current load. Thus, the transconductance $gm_D$ of the diode-connected FET 330 is also a function of the current load. When the load current decreases, the feedback loop 125 decreases the source-to-gate voltage $V_{SG_P}$ of the pass transistor 120 to maintain the regulated voltage Vreg at the desired voltage. The decrease in the source-to-gate voltage $V_{SG_P}$ of the pass transistor 120 causes the source-to-gate voltage $V_{SG_D}$ and the transconductance $gm_D$ of the diode-connected FET 330 to decrease.

Figure 4:
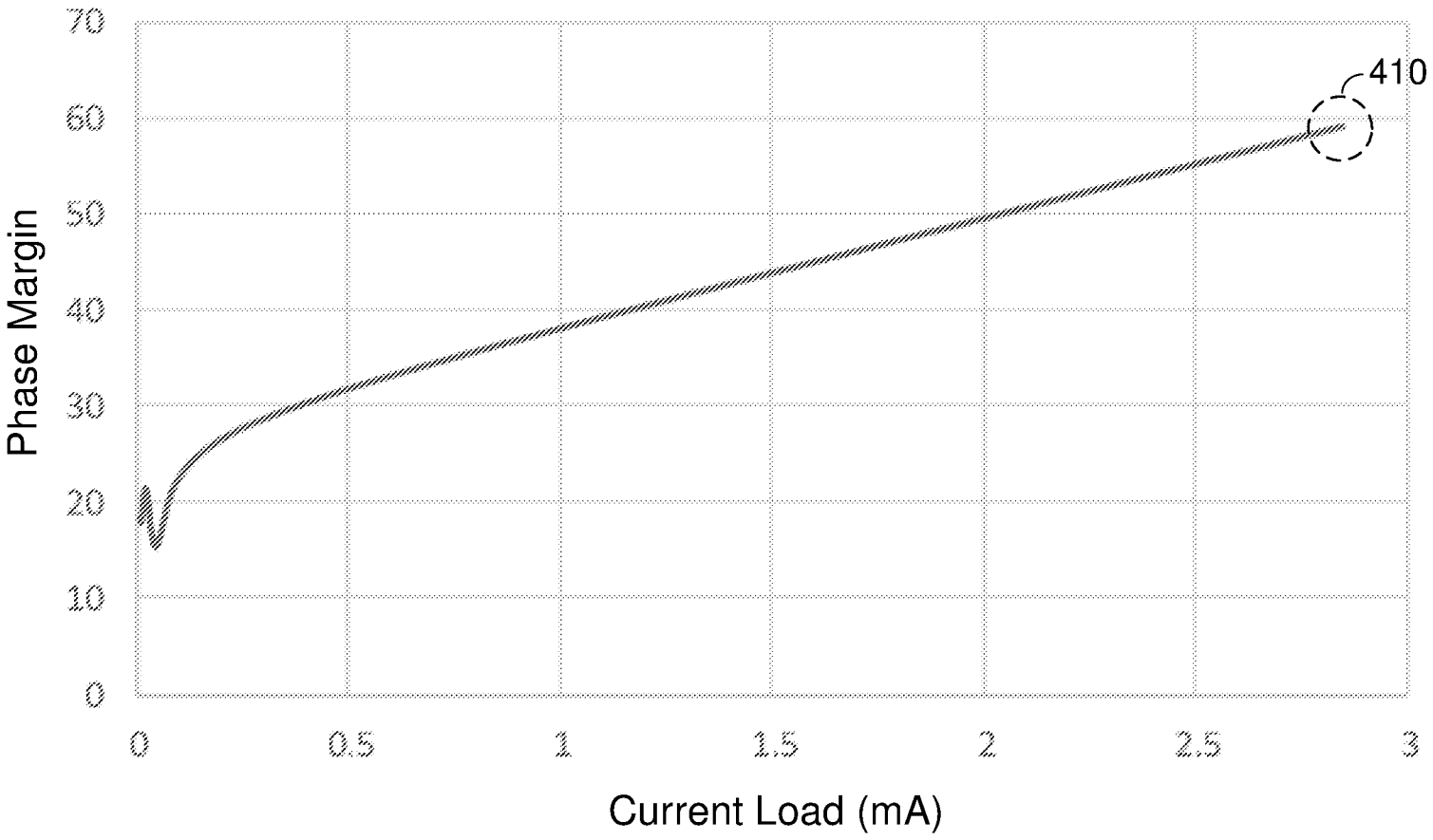
FIG. 4 is a plot showing an example of phase margin as a function of current load for the LDO regulator in FIG. 3 according to certain aspects of the present disclosure.

Since the non-dominate pole is a function of the transconductance $gm_D$ of the diode-connected FET 330 and the transconductance $gm_D$ of the diode-connected FET 330 is a function of the current load, the non-dominate pole is also function of the current load. The dependency of the non-dominate pole on the current load causes the phase margin of the LDO regulator 110 to change with changes in the current load, making it difficult to provide an adequate phase margin (e.g., phase margin of 60°) for loop stability over a large range of current load conditions. This can be demonstrated by way of example. FIG. 4 shows an example of the phase margin of the feedback loop 125 as a function of the current load. In this example, the LDO regulator 110 has a phase margin of approximately 60° at a current load of 3 mA, and therefore has good loop stability at a current load of 3 mA. However, as the current load decreases from 3 mA to approximately zero amps, the phase margin decreases significantly due to the dependency of the transconductance $gm_D$ of the diode-connected FET 330 on the current load. The large decrease in the phase margin significantly degreases the loop stability of the LDO regulator 110.

To address the above problem, aspects of the present disclosure provide an adjustable voltage source between the drain and the gate of the diode-connected FET load. The voltage of the adjustable voltage source is adjusted in response to changes in the current load to maintain a high phase margin (e.g., above 60°) across a large current load range, as discussed further below.

Figure 5:
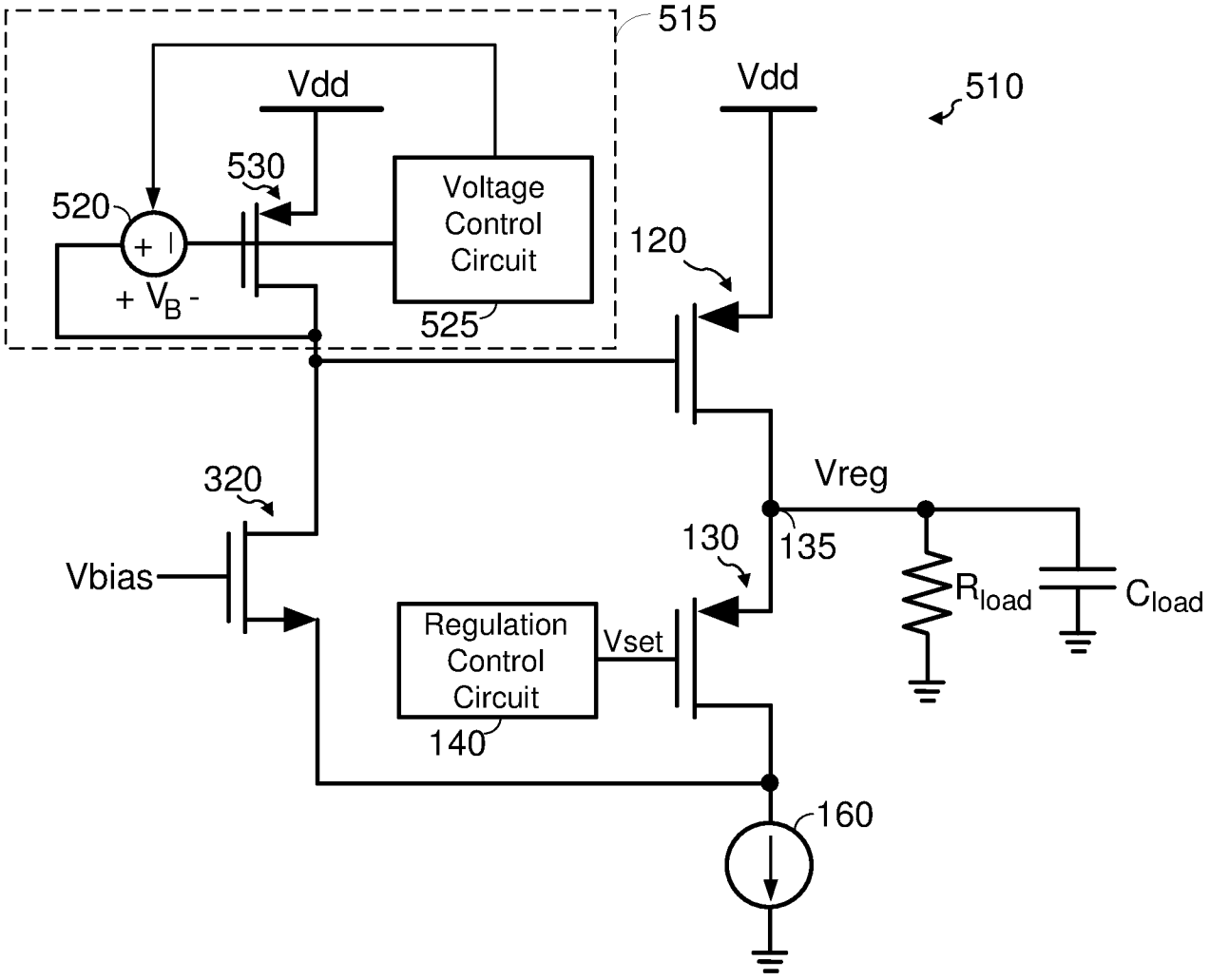
FIG. 5 shows an LDO regulator with improved loop stability over a large current load range according to certain aspects of the present disclosure.

FIG. 5 shows an LDO regulator 510 with improved loop stability over a large current load range according to certain aspects of the present disclosure. The LDO regulator 510 includes the pass transistor 120, the transistor 130, the regulation control circuit 140, the current source 160, and the common-gate amplifier 320 coupled to the transistor 130 in the folded cascode configuration discussed above with references to FIGS. 1-3. Since these components are described in detail above, a detailed description of these components is not repeated here for brevity.

The LDO regulator 510 also includes a load circuit 515 that provides the improved loop stability over the large current load range. The load circuit 515 includes a diode-connected FET 530, an adjustable voltage source 520 and a voltage control circuit 525. In the example in FIG. 5, the diode-connected FET 530 is implemented with a PFET, in which the source of the PFET is coupled to the supply rail Vdd, and the drain of the PFET is coupled to a node between the gate of the pass transistor 120 and the output of the common-gate amplifier 320.

The adjustable voltage source 520 is coupled between the drain and the gate of the diode-connected FET 530, and is configured to provide a voltage $V_B$ that is adjusted by the voltage control circuit 525. In the example in FIG. 5, the drain-to-gate voltage of the diode-connected FET 530 is approximately equal to the voltage $V_B$ of the adjustable voltage source 520. The source-to-gate voltage $V_{SG_D}$ of the diode-connected FET 530 is given by:

$$V_{SG_D}=V_B+V_{SG_P} \quad (2)$$

Thus, the source-to-gate voltage $V_{SG_D}$ of the diode-connected FET 350 is a function of both the source-to-gate voltage $V_{SG_P}$ of the pass transistor 120 and the voltage $V_B$ of the adjustable voltage source 520. In contrast, for the diode-connected FET 330 in FIG. 3 in which the gate and drain of the diode-connected FET 330 are directly tied together, the source-to-gate voltage $V_{SG_D}$ of the diode-connected FET 330 is equal to the source-to-gate voltage $V_{SG_P}$ of the pass transistor 120 (i.e., $V_{SG_D}=V_{SG_P}$).

The voltage control circuit 525 is configured to adjust the voltage $V_B$ of the adjustable voltage source 520 in response to changes in the current load through the pass transistor 120. The voltage control circuit 525 may detect changes in the current load directly. Alternatively, the voltage control circuit 525 may detect changes in the current load indirectly by detecting changes in a voltage affected by the current load. For example, the voltage control circuit 525 may indirectly detect changes in the current load by detecting changes in the source-to-gate voltage $V_{SG_P}$ of the pass transistor 120 caused by changes in the current load. The voltage control circuit 525 may also indirectly detect changes in the current load by detecting changes in the source-to-gate voltage $V_{SG_D}$ of the diode-connected FET 530 since the source-to-gate voltage $V_{SG_D}$ of the diode-connected FET 530 is a function of the source-to-gate voltage $V_{SG_P}$ of the pass transistor 120 (i.e., a change in $V_{SG_P}$ due to a change in the current load causes a change in $V_{SG_D}$). Thus, as used herein, detection of a change in the current load covers both direct and indirect detection of the change in the current load.

Figure 6:
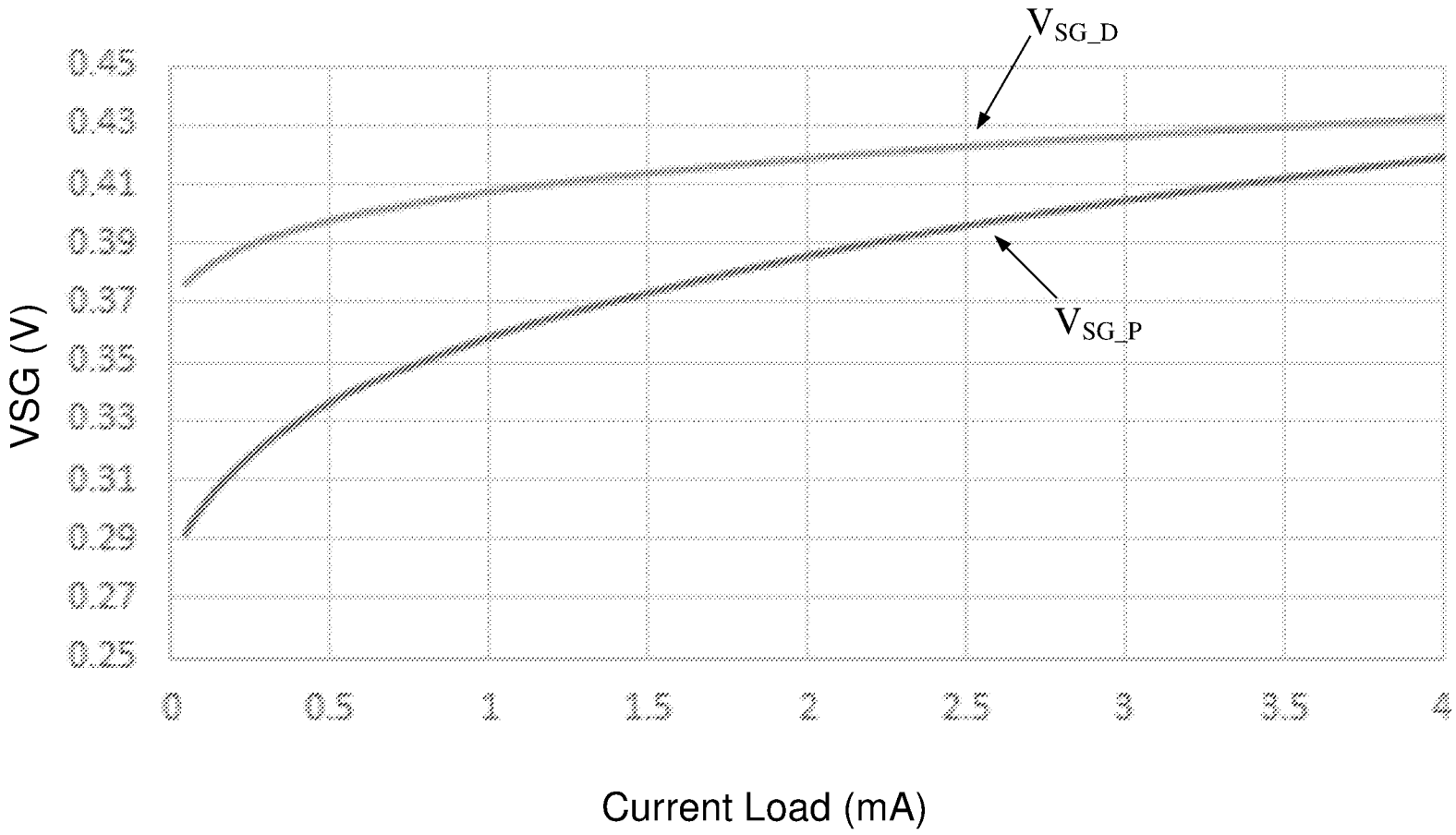
FIG. 6 is a plot showing an example of the source-to-gate voltage of a diode-connected FET and the source-to-gate voltage of a pass transistor across a current load range according to certain aspects of the present disclosure.

In certain aspects, when the voltage control circuit 525 detects a change in the current load, the voltage control circuit 525 adjusts the voltage $V_B$ of the adjustable voltage source 520 in a direction that is opposite to the direction of the change in the source-to-gate voltage $V_{SG_P}$ of the pass transistor 120 due to the change in the current load. For example, if the source-to-gate voltage $V_{SG_P}$ of the pass transistor 120 decreases due to a decrease in the current load, the voltage control circuit 525 increases the voltage $V_B$ of the adjustable voltage source 520. By adjusting the $V_B$ voltage of the adjustable voltage source 520 in the opposite direction as $V_{SG_P}$, the voltage of the adjustable voltage source 520 counter acts the change in $V_{SG_P}$ due to the current load change. As a result, the source-to-gate voltage $V_{SG_D}$ of the diode-connected FET 530 changes by a smaller amount than the source-to-gate voltage $V_{SG_P}$ of the pass transistor 120 due to the current load change. An example of this is illustrated in FIG. 6, which shows an exemplary plot of $V_{SG_P}$ and $V_{SG_D}$ across a current load range of 0 mA to 4 mA. As shown in FIG. 6, the source-to-gate voltage $V_{SG_D}$ of the diode-connected FET 530 changes by a smaller amount across the current load range compared with the source-to-gate voltage $V_{SG_P}$ of the pass transistor 120.

Since the transconductance $gm_D$ of the diode-connected FET 530 is a function of $V_{SG_D}$ and $V_{SG_D}$ changes by a smaller amount than $V_{SG_P}$, the transconductance $gm_D$ of the diode-connected FET 530 changes by a smaller amount due to current load change compared with the diode-connected FET 330 in FIG. 3. As a result, the transconductance $gm_D$ of the diode-connected FET 530 is flatter across a large current load range compared with the diode-connected FET 330 in FIG. 3, and therefore does not suffer from the large degradation in the phase margin shown in FIG. 4 due to a large change in the transconductance $gm_D$ across the current load range. This allows the LDO regulator 510 to achieve a high phase margin across a large current load range (e.g., 0 mA to 3 mA) providing good loop stability across the large current load range.

Figure 7:
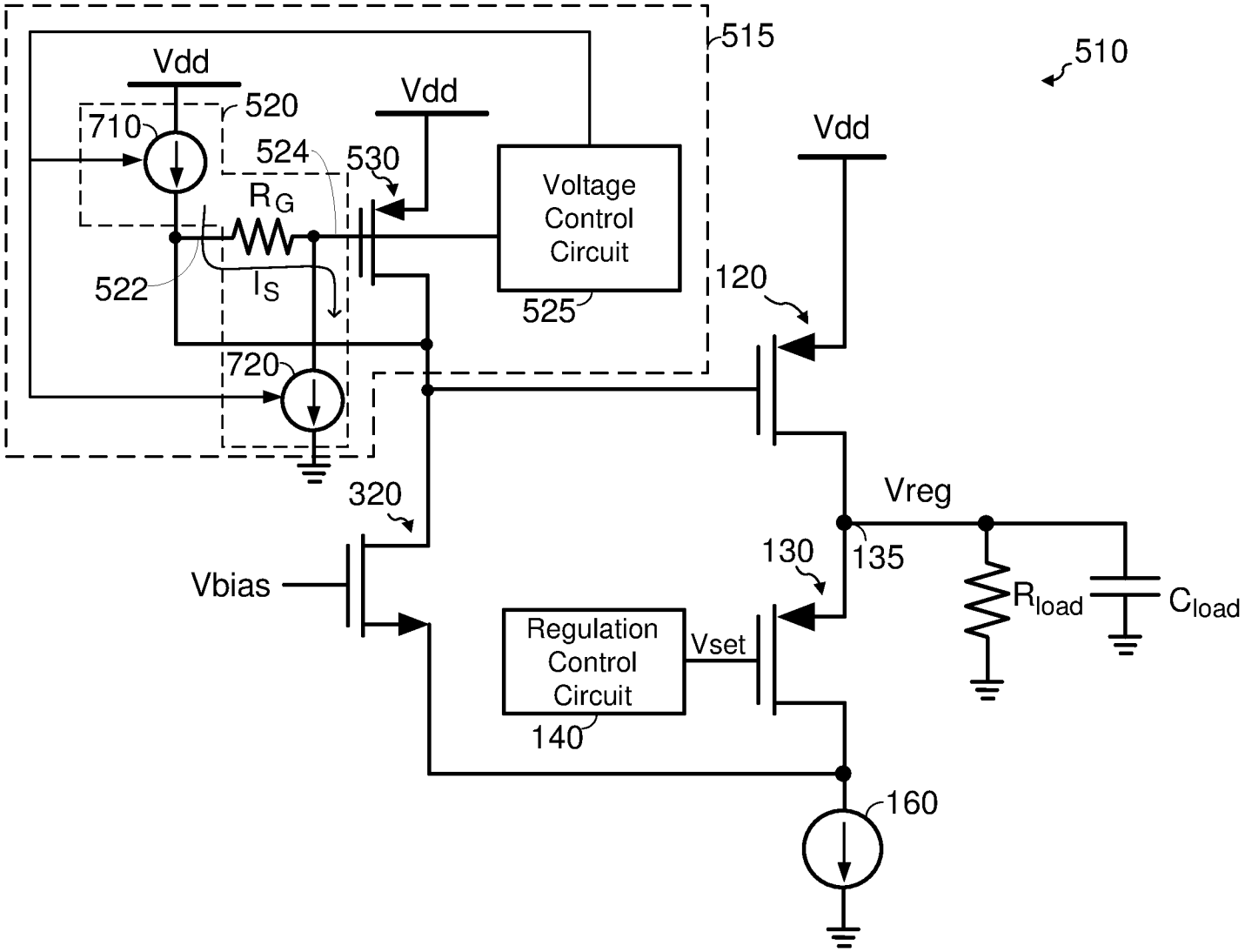
FIG. 7 shows an exemplary implementation of an adjustable voltage source according to certain aspects of the present disclosure.

FIG. 7 shows an exemplary implementation of the adjustable voltage source 520 according to certain aspects of the present disclosure. In this example, the adjustable voltage source 520 includes a first adjustable current source 710, a second adjustable current source 720, and a gate resistor $R_G$. The gate resistor $R_G$ is coupled between the drain and the gate of the diode-connected FET 530. The first adjustable current source 710 is coupled between the supply rail Vdd and a first end 522 of the gate resistor $R_G$. The second adjustable current source 720 is coupled between a second end 524 of the gate resistor $R_G$ and ground, in which the first and second ends 522 and 524 of the gate resistor $R_G$ are opposite ends of the gate resistor $R_G$.

In certain aspects, the first and second adjustable current sources 710 and 720 have approximately the same current (labeled "$I_S$" in FIG. 7), which is controlled by the voltage control circuit 525. Because the first and second adjustable current sources 710 and 720 are coupled to opposite ends of the gate resistor $R_G$, the current $I_S$ of the first and second adjustable current sources 710 and 720 flows through the gate resistor $R_G$, generating a voltage of $I_S \cdot R_G$ across the gate resistor $R_G$. The current $I_S$ flows through the gate resistor $R_G$ from the end 522 of the gate resistor $R_G$ coupled to the drain of the diode-connected FET 530 to the end 524 of the gate resistor $R_G$ coupled to the gate of the diode-connected FET 530, as shown in FIG. 7. Thus, in this example, the voltage $V_B$ of the adjustable voltage source 520 is given by $I_S \cdot R_G$ (i.e., $V_B = I_S \cdot R_G$).

In this example, the voltage control circuit 525 adjusts the voltage $V_B$ of the adjustable voltage source 520 by adjusting the current $I_S$ of the first and second adjustable current sources 710 and 720. In this regard, the voltage control circuit 525 decreases the voltage $V_B$ of the adjustable voltage source 520 by decreasing the current $I_S$, and increases the voltage $V_B$ of the adjustable voltage source 520 by increasing the current $I_S$.

Figure 8:
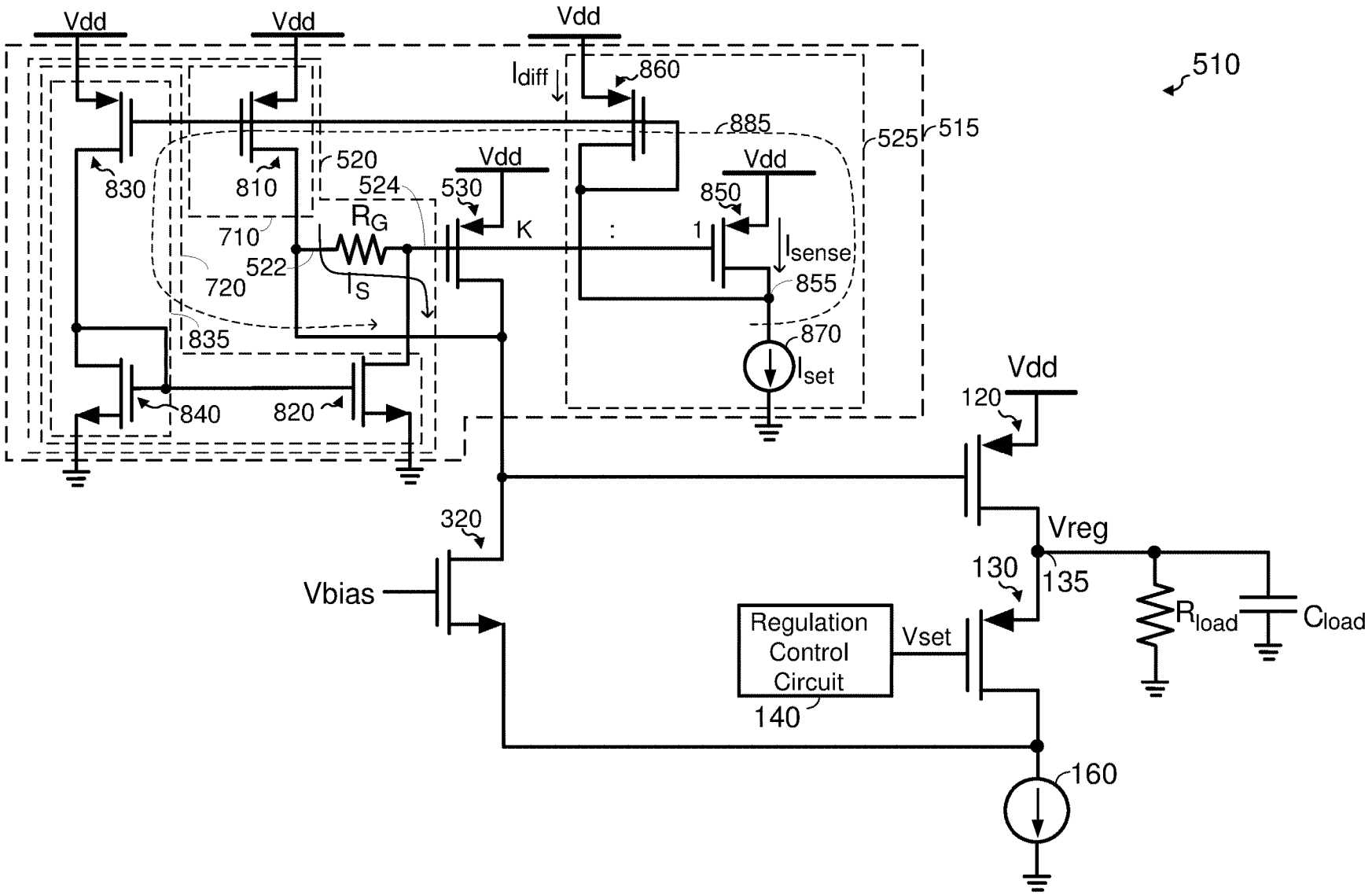
FIG. 8 shows an exemplary implementation of a voltage control circuit according to certain aspects of the present disclosure.

FIG. 8 shows an exemplary implementation of the voltage control circuit 525 and the first and second adjustable current sources 710 and 720 according to certain aspects of the present disclosure. In this example, the first adjustable current source 710 includes a first PFET 810, in which the source of the first PFET 810 is coupled to the supply rail and the drain of the first PFET 810 is coupled to the first end 522 of the gate resistor $R_G$. As discussed further below, the voltage control circuit 525 is coupled to the gate of the first PFET 810 to control the current of the first adjustable current source 710.

The second adjustable current source 720 includes a first NFET 820, in which the drain of the first NFET 820 is coupled to the second end 524 of the gate resistor $R_G$ and the source of the first NFET 820 is coupled to ground. The second adjustable current source 720 also includes a current mirror 835 coupled to the gate of the first PFET 810 and the gate of the first NFET 820. The current mirror 835 is configured to mirror the same current as the first PFET 810 such that the first NFET 820 has approximately the same current as the first PFET 810 (i.e., current $I_S$ in FIG. 7). This current (i.e., $I_S$) flows through the gate resistor $R_G$ to generate the voltage $V_B$ of the adjustable voltage source 520.

The current mirror 835 includes a second PFET 830 and a second NFET 840. The source of the second PFET 830 is coupled to the supply rail Vdd and the gate of the second PFET 830 is coupled to the gate of the first PFET 810. The drain of the second NFET 840 is coupled to the drain of the second PFET 830, the gate of the second NFET 840 is coupled to the gate of the first NFET 820, and the source of the second NFET 840 is coupled to ground. The drain of the second NFET 840 is tied to the gate of the second NFET 840.

The voltage control circuit 525 includes a third PFET 850, a fourth PFET 860 and a current source 870. The source of the third PFET 850 is coupled to the supply rail Vdd, and the gate of the third PFET 850 is coupled to the gate of the diode-connected FET 530. The source of the fourth PFET 860 is coupled to the supply rail Vdd, the gate of the fourth PFET 860 is coupled to the gate of the first PFET 810, and the drain of the fourth PFET 860 is coupled to the drain of the third PFET 850 at node 855. The drain of the fourth PFET 860 is tied to the gate of the fourth PFET 860. The current source 870 is coupled between node 855 and ground, and is configured to provide a current $I_{set}$ that flows from node 855 to ground. The current source 870 may generate the current $I_{set}$ from a constant-gm bias circuit.

In operation, the third PFET 850 produces a sense current $I_{sense}$ that is proportional to the current of the diode-connected FET 530. This is because the gate of the third PFET 850 is coupled to the gate of diode-connected FET 530. In certain aspects, the current ratio between the diode-connected FET 530 and the third PFET 850 is K:1 such that the sense current $I_{sense}$ is equal to 1/K the current of the diode-connected FET 530. The current ratio may be determined, for example, by the channel widths of the diode-connected FET 530 and the third PFET 850. The third PFET 850 may be considered a sense transistor since it senses the current through the diode-connected FET 530 by producing a current (i.e., $I_{sense}$) that is proportional to the current through the diode-connected FET 530.

The current of the diode-connected FET 530 is a function of the source-to-gate voltage $V_{SG_D}$ of the diode-connected FET 530, which, in turn, is a function of the source-to-gate voltage $V_{SG_P}$ of the pass transistor 120. The source-to-gate voltage $V_{SG_P}$ of the pass transistor 120, in turn, is a function of the current load, as discussed above. Thus, the current of the diode-connected FET 530 is a function of the current load. Since the sense current $I_{sense}$ is proportional to current of the diode-connected FET 530, the sense current $I_{sense}$ is also a function of the current load, and therefore can be use to detect (i.e., sense) changes in the current load.

The sense current $I_{sense}$ is subtracted from the current $I_{set}$ of the current source 870 at node 855, producing a difference current $I_{diff}$. The difference current $I_{diff}$ is given by:

$$I_{diff}=I_{set}-I_{sense} \quad (3).$$

The difference current $I_{diff}$ flows through the fourth PFET 860, as indicated in FIG. 8. The difference current $I_{diff}$ is mirrored to the first PFET 810 since the gate of the fourth 860 is coupled to the gate of the first PFET 810. The difference current $I_{diff}$ is also mirrored to the first NFET 820 through the current mirror 835. Assuming the current ratio between the fourth PFET 860 and the first PFET 810 is 1:1 for simplicity, the current $I_S$ of the first and second adjustable current sources 710 and 720 is approximately equal to $I_{diff}$. In this example, the voltage $V_B$ of the adjustable voltage source 520 is given by:

$$V_B=I_{diff}\cdot R_G \quad (4).$$

Thus, in this example, the source-to-gate voltage $V_{SG_D}$ of the diode-connected FET 530 is given by:

$$V_{SG_D}=I_{diff}\cdot R_G+V_{SG_P} \quad (5).$$

In operation, the voltage control circuit 525 implements a feedback loop 885 that senses a change in the source-to-gate voltage $V_{SG_D}$ of the diode-connected FET 530 due to a change in the current load through the pass transistor 120, and changes the voltage $V_B$ of the adjustable voltage source 520 in the opposite direction to reduce the change in the source-to-gate voltage $V_{SG_D}$ of the diode-connected FET 530. This feedback reduces sensitivity of the source-to-gate voltage $V_{SG_D}$ of the diode-connected FET 530 to current load changes, which flattens the transconductance $gm_D$ of the diode-connected FET 530 across a large current load range compared with the diode-connected FET 330 in FIG. 3. The flatter transconductance allows the LDO regulator 510 to achieve high phase margins across a large current load range (e.g., 0 mA to 3 mA) providing good loop stability across the large current load.

The feedback loop 885 may be better understood by way of the following example. When the source-to-gate voltage $V_{SG_D}$ of the diode-connected FET 530 decreases due to a decrease in the current load through the pass transistor 120, the decrease in the source-to-gate voltage $V_{SG_D}$ of the diode-connected FET 530 causes the sense current $I_{sense}$ to decrease. The decrease in the sense current $I_{sense}$ causes the difference current $I_{diff}$ to increases since the difference current $I_{diff}$ is equal to $I_{set}-I_{sense}$. The increase in the difference current $I_{diff}$ increases the voltage $V_B$ of the adjustable voltage source 520 (see equation (4)). The increase in the voltage $V_B$ of the adjustable voltage source 520 counter acts the decrease in the source-to-gate voltage $V_{SG_P}$ of the pass transistor 120 (see equation (5)), resulting in a smaller change in the source-to-gate voltage $V_{SG_D}$ of the diode-connected FET 530 compared with the source-to-gate voltage $V_{SG_P}$ of the pass transistor 120.

Figure 9:
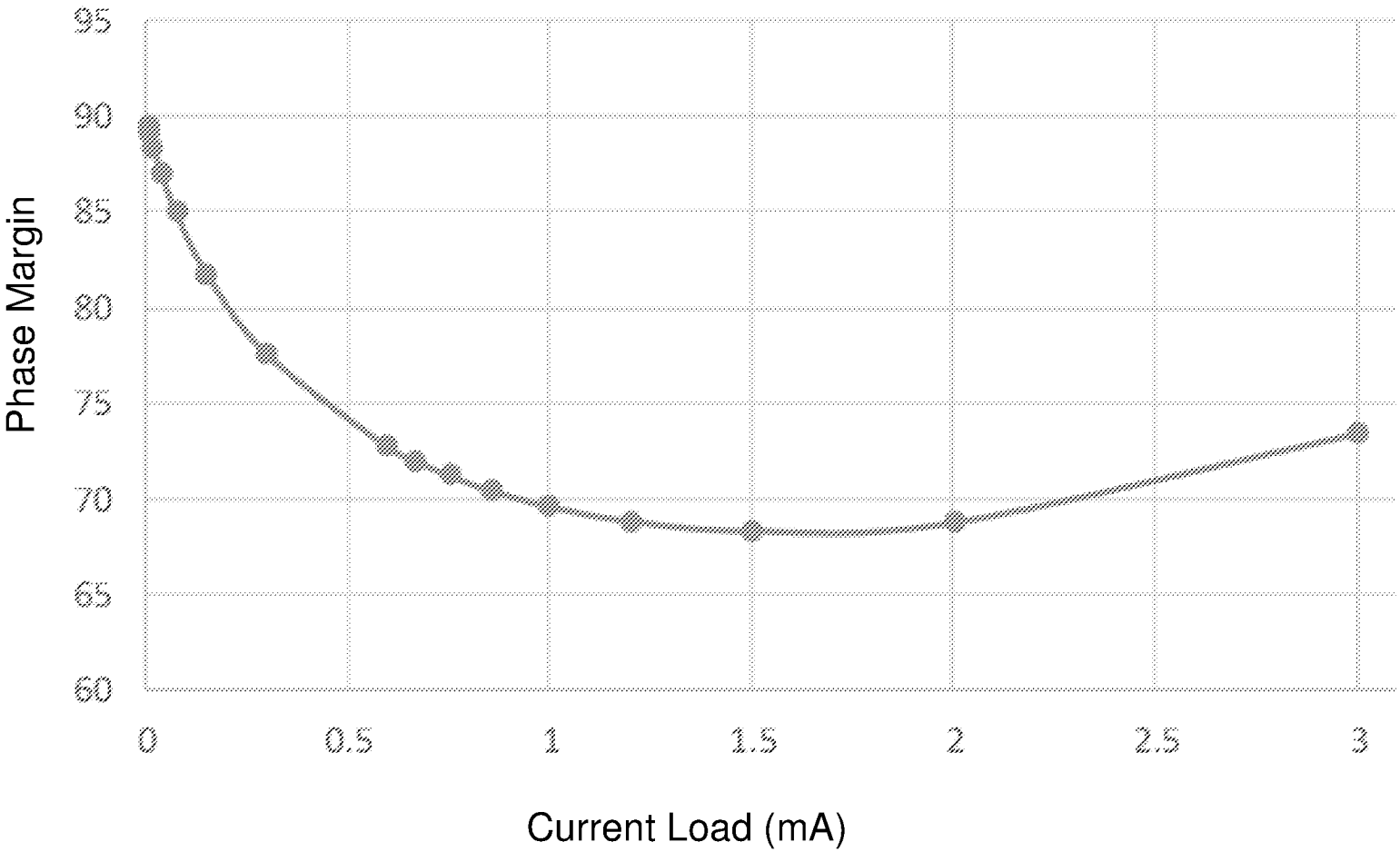
FIG. 9 is a plot showing an example of phase margin across a large current load range for the LDO regulator in FIG. 8 according to certain aspects of the present disclosure.

FIG. 9 is a plot illustrating an example of phase margin across a large current load range (i.e., 0 mA to 3 mA) provided by the LDO regulator 510 in FIG. 8. In this example, the current $I_{set}$ of the current source 870 is set to 15 μA, the current ratio K:1 is 4:1, the resistance of the gate resistor $R_G$ is 5 kΩ, and the load capacitance is approximately 12 pF/1 mA. As shown in FIG. 9, the phase margin stays above 60° across the entire current load range, providing good loop stability across the entire current load range. Thus, the LDO regulator 510 is stable across a large current load range (e.g., 0 mA to 3 mA), and can therefore operate under a wide range of different current load conditions.

The values of K, the gate resistance $R_G$, and/or the current $I_{set}$ may be determined during the design phase of the LDO regulator 510. For example, during the design phase, experiments and/or simulations may be performed on the LDO regulator 510 using different values for K, the gate resistance $R_G$, and/or the current $I_{set}$ to determine values that result in a phase margin that stays above a phase-margin threshold (e.g., 60°) across a desired current load range (e.g., 0 mA to 3 mA).

It is to be appreciated that the load circuit 515 is not limited to the exemplary LDO regulator 515 shown in FIG. 5, and may be used in other LDO regulator topologies to provide high phase margins over a large current range. In general, the load circuit 515 may be use in other LDO regulator topologies in which the load circuit 515 is coupled to a node that is located between the output of an amplifier (e.g., common-gate amplifier 320) and the gate of the pass transistor. The input of the amplifier is coupled to the output of the LDO regulator via feedback path. In the example in FIG. 5, the transistor 130 is in the feedback path.

As discussed above, the LDO regulator 510 has a low dropout voltage (e.g., as low as a few tens of millivolts), which allows the LDO regulator 510 to be used to power a circuit from a low supply voltage (e.g., a minimum supply voltage of less than 2Vt). However, some use cases may require an even lower dropout voltage (e.g., dropout voltage less than 10 mV) to support an even lower supply voltage (e.g., a supply voltage approaching one Vt). In these use cases, a power switch with low on resistance may be used to power the circuit from a very low supply voltage, as discussed further below.

Figure 10:
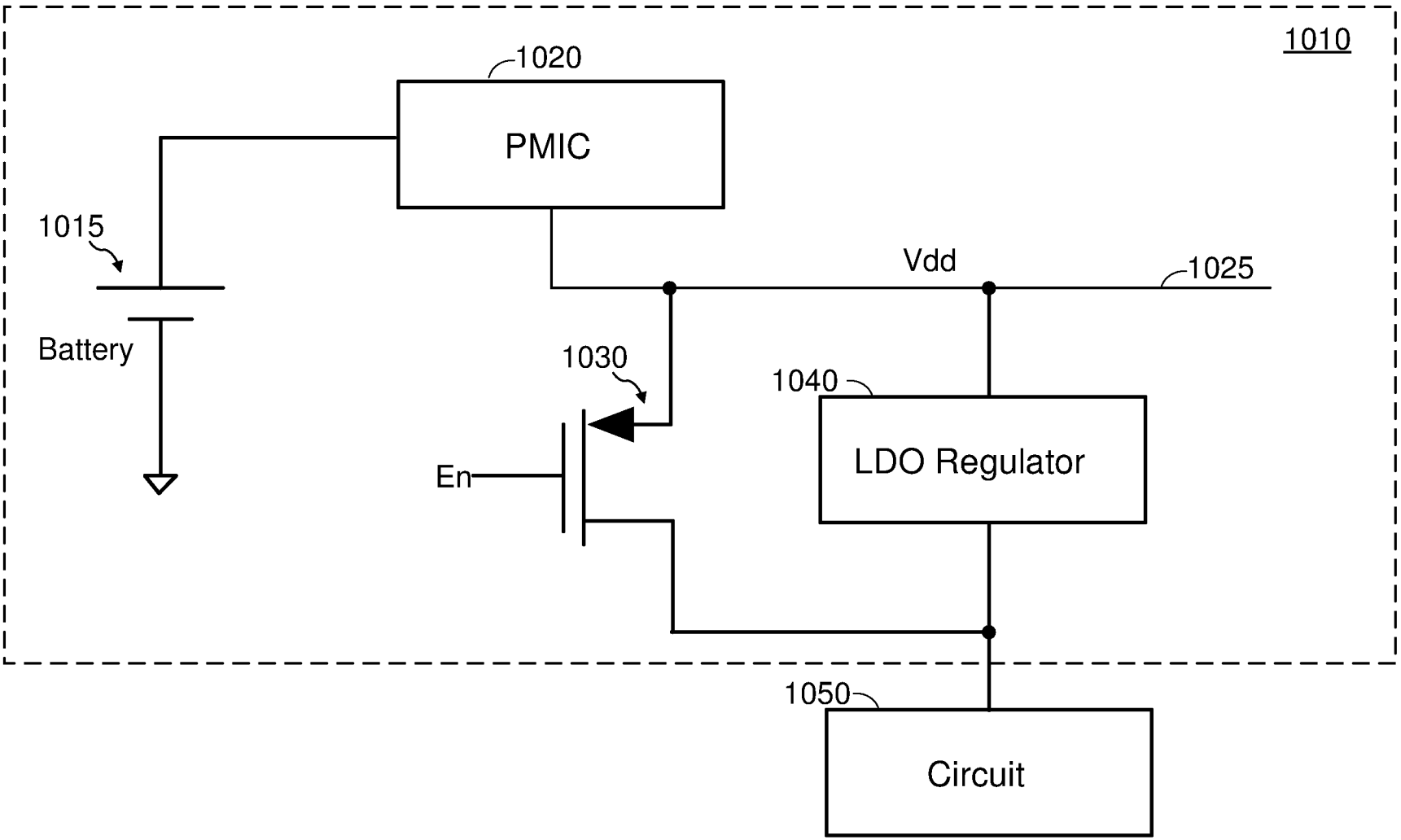
FIG. 10 shows an example of a power system including an LDO regulator and a power switch according to certain aspects of the present disclosure.

FIG. 10 shows an example of a power system 1010 according to certain aspects of the present disclosure. The power system 1010 is configured to provide power to a circuit 1050, which may include one or more analog circuits, one or more digital circuits, or both. The power system 1010 includes a power management integrated circuit (PMIC), a supply rail 1025, a power switch 1030, an LDO regulator 1040, and a power source 1015 (e.g., a battery). The power switch 1030 and the LDO regulator 1040 are arranged in parallel between the supply rail 1025 and the circuit 1050.

The PMIC 1020 is configured to convert a voltage from the power source 1015 into the supply voltage on the supply rail 1025. In certain aspects, the PMIC 1020 is configured to set the voltage level of the supply voltage to any one of multiple voltage levels based on, for example, the current use case of the circuit 1050. For example, the circuit 1050 may be configured to operate at any one of multiple clock frequencies at a time. In this example, the PMIC 1020 may set the voltage level of the supply voltage based on the current clock frequency of the circuit 1050.

In the example in FIG. 10, the power switch 1030 is implemented with a PFET, in which the source of the PFET is coupled to the supply rail 1025, the drain of the PFET is coupled to the circuit 1050, and the gate of the PFET receives an enable signal En. When the enable signal En is high, the power switch 1030 is turned off, and, when the enable signal En is low (e.g., grounded), the power switch 1030 is turned on. When turned on, the power switch 1030 has a low on resistance, resulting in a very low dropout voltage (e.g., <10 mV). The low on resistance may be achieved by implementing the power switch 1030 with a large PFET having a large width-to-length ratio. When the power switch 1030 is turned on, the voltage at the circuit 1050 is very close to the supply voltage on the supply rail 1025 due to the very low dropout voltage (e.g., <10 mV) of the power switch 1030.

The LDO regulator 1040 is coupled between the supply rail 1025 and the circuit 1050, and is configured to provide a regulated voltage to the circuit 1050 from the supply voltage on the supply rail 1025. The LDO regulator 1040 may be implemented with the LDO regulator 510 discussed above. The LDO regulator 1040 has a low dropout voltage, although not as low as the power switch 1030.

In this example, the power system 1010 can operate in a voltage-regulation mode or a power-switch mode. In the voltage-regulation mode, the power switch 1030 is turned off and the LDO regulator 1040 is turned on (e.g., enabled). In this mode, the circuit 1050 is powered using the regulated voltage provided by the LDO regulator 1040. In the power-switch mode, the LDO regulator 1040 is tuned off (e.g., disabled), and the power switch 1030 is turned on. In this mode, the power switch 1030 provides a low resistance path between the supply rail 1025 and the circuit 1050 with very low voltage dropout. The power-switch mode may be used, for example, when the PMIC 1020 sets the supply voltage below the minimum supply voltage supported by the LDO regulator 1040.

In certain aspects, instead of using a separate power switch 1030 in the power-switch mode, the LDO regulator 1040 is configured to function as a power switch in the power-switch mode. This allows the power switch 1030 in FIG. 10 to be removed from the power system 1010, significantly reducing the area of the power system.

Figure 11A:
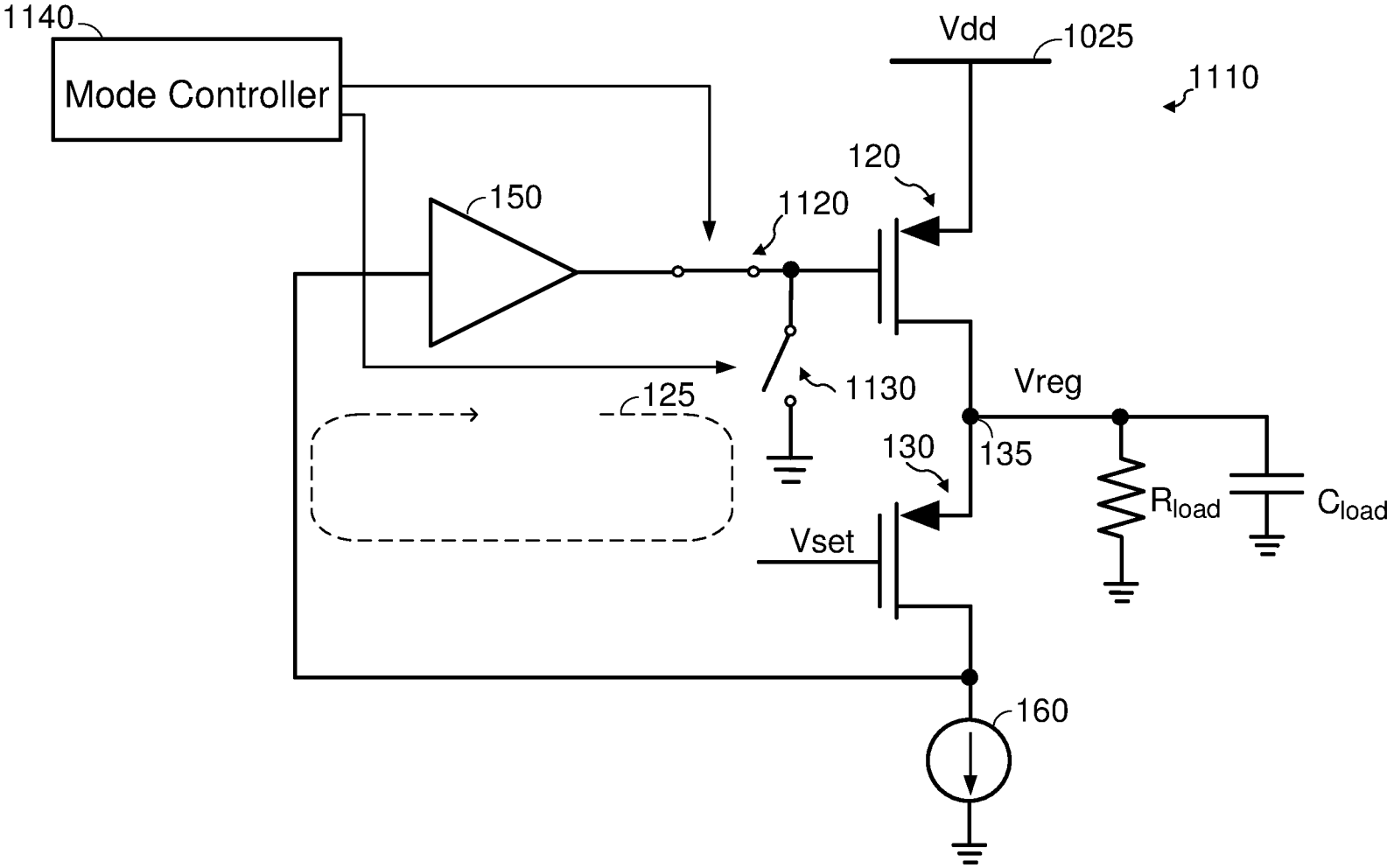
FIG. 11A shows an example of an LDO regulator configured to operate in a voltage-regulation mode according to certain aspects of the present disclosure.
Figure 11B:
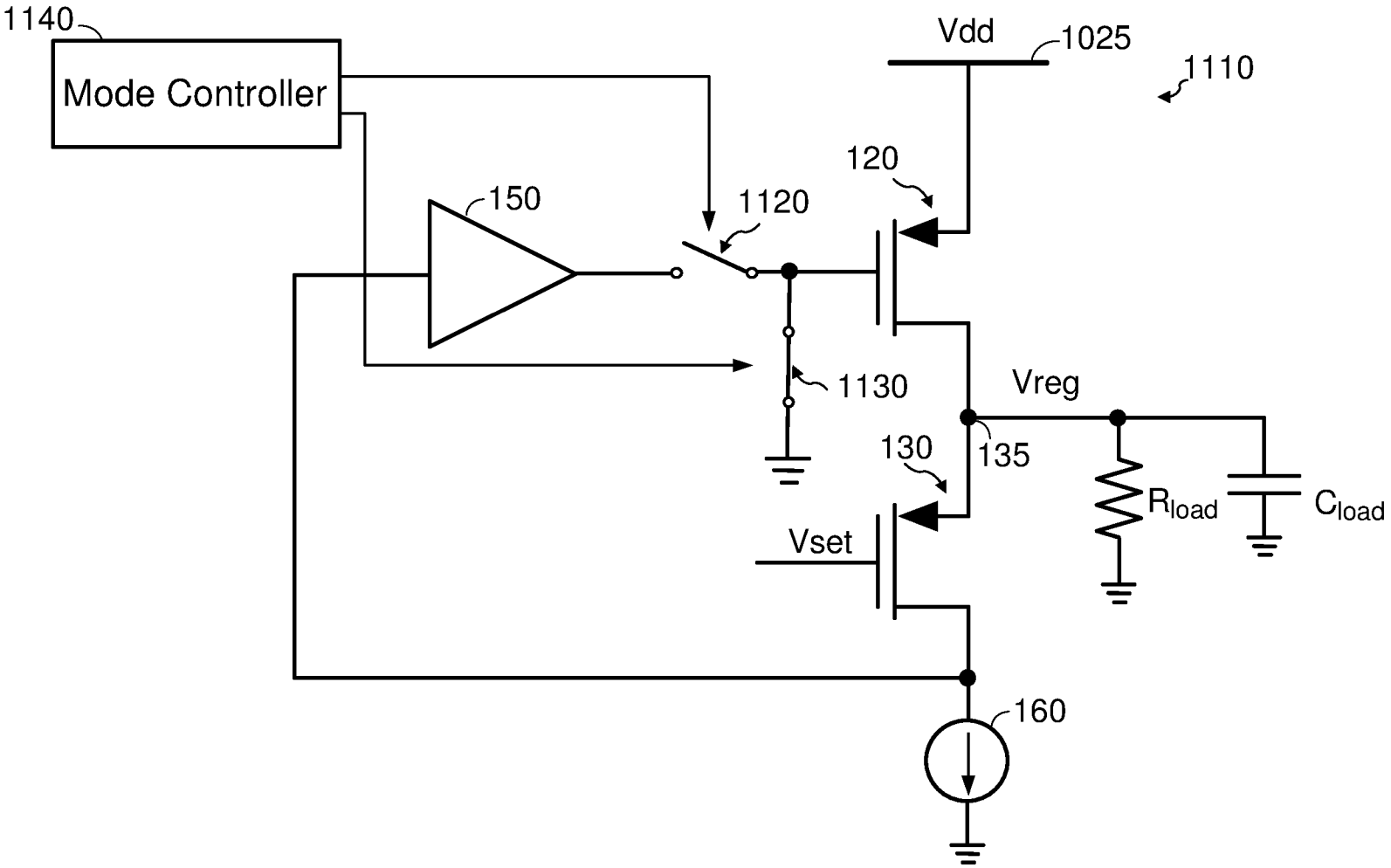
FIG. 11B shows an example of the LDO regulator in FIG. 11A configured to operate in a power-switch mode according to certain aspects of the present disclosure.

In this regard, FIGS. 11A and 11B show an exemplary LDO regulator 1110 capable of operating in a voltage-regulation mode or a power-switch mode according to certain aspects of the present disclosure. The LDO regulator 1110 includes the pass transistor 120, the transistor 130, the regulation control circuit 140 (not shown in FIGS. 11A and 11B), the current source 160, and the amplifier 150 discussed above. The amplifier 150 may be implemented with the common-gate amplifier 320 and the load circuit 515 discussed above. Since the above components are described in detail above, a detailed description of these components is not repeated here for brevity.

The LDO regulator 1110 also includes a first switch 1120 and a second switch 1130. The first switch 1120 is between the output of the amplifier 150 and the gate of the pass transistor 120, and the second switch 1130 is between the gate of the pass transistor 120 and ground. The first and second switches 1120 and 1130 are controlled by a mode controller 1140. The mode controller 1140 is configured to control the mode of operation of the LDO regulator 1110 using the first and second switches 1120 and 1130.

To operate the LDO regulator 1110 in the voltage-regulation mode, the mode controller 1140 turns on (i.e., closes) the first switch 1120 and turns off (opens) the second switch 1130, as shown in FIG. 11A. As a result, the output of the amplifier 150 is coupled to the gate of the pass transistor 120 through the first switch 1120, thereby enabling the feedback loop 125 of the LDO regulator 1110. In this mode, the LDO regulator 1110 operates as discussed above to provide a regulated voltage Vreg at the output 135. The output 135 may be coupled to the circuit 1050 shown in FIG. 10. The load capacitance $C_{load}$ may include capacitance from the circuit 1050.

To operate the LDO regulator 1110 in the power-switch mode, the mode controller 1140 turns off (i.e., opens) the first switch 1120 and turns on (closes) the second switch 1130, as shown in FIG. 11B. As a result, the gate of the pass transistor 120 is coupled to ground through the second switch 1130, which fully turns on the pass transistor 120. In this mode, the pass transistor 120 is configured as a power switch that is turned on, providing a low resistance path between the supply rail 1025 and the output 135 through the pass transistor 120. Because the pass transistor 120 is fully turned on, the dropout voltage of the pass transistor 120 is very low (e.g., 10 mV) in this mode. In the power-switch mode, the feedback loop 125 of the LDO regulator 1110 is disabled, and therefore does not provide a regulated voltage.

Thus, in the power-switch mode, the pass transistor 120 of the LDO regulator 1110 is reused as a power switch without the need for the separate power switch 1030 shown in FIG. 10. In this regard, the pass transistor 120 may be implemented with a large PFET having a large width-to-length ratio to provide a low on resistance in the power-switch mode.

In the power-switch mode, the load capacitance $C_{load}$ may be large enough to help filter out noise on the supply voltage. For example, the load capacitance $C_{load}$ may provide high supply noise rejection (e.g., >6 dB of supply noise rejection) at high frequencies (e.g., above 50 MHz).

Also, in the power-switch mode, the mode controller 1140 may power off the transistor 130, the current source 160 and/or the amplifier 150. For example, for the example in which the transistor 130 is implemented with an PFET, the mode controller 1140 may power off the transistor 130 by coupling the gate of the transistor 130 to the supply voltage.

The mode controller 1140 may control the mode of operation of the LDO regulator 1110 based on the supply voltage on the supply rail 1025 set by the PMIC 1020. In this example, the mode controller 1140 may receive a signal (e.g., from a power controller) indicating the voltage level of the supply voltage on the supply rail 1025 provided by the PMIC 1020. If the signal indicates that the voltage level of the supply voltage is equal to or above a voltage threshold, then the mode controller 1140 operates the LDO regulator 1110 in the voltage-regulation mode. The threshold may be equal to a minimum supply voltage at which the dropout voltage of the LDO regulator 1110 in the voltage-regulation mode is acceptable. If the signal indicates that the voltage level of the supply voltage is below the voltage threshold, then the mode controller 1140 operates the LDO regulator 1110 in the power-switch mode.

In one example, the PMIC 1020 may support multiple supply voltage levels for the supply voltage including a first voltage level and a second voltage level in which the second voltage level is below the first voltage level. In this example, the mode controller 1140 may receive a signal indicating one of the multiple voltage levels. The mode controller 1140 may be programmed to operate the LDO regulator 1110 in the voltage-regulation mode if the signal indicates the first voltage level and to operate the LDO regulator 1110 in the power-switch mode if the signal indicates the second voltage level. In this example, the second voltage level may be below the minimum supply voltage level supported by the LDO regulator in the voltage-regulation mode. It is to be appreciated that the multiple voltage levels supported by the PMIC 1020 may include additional voltage levels in addition to the first and second voltage levels discussed above.

Figure 12:
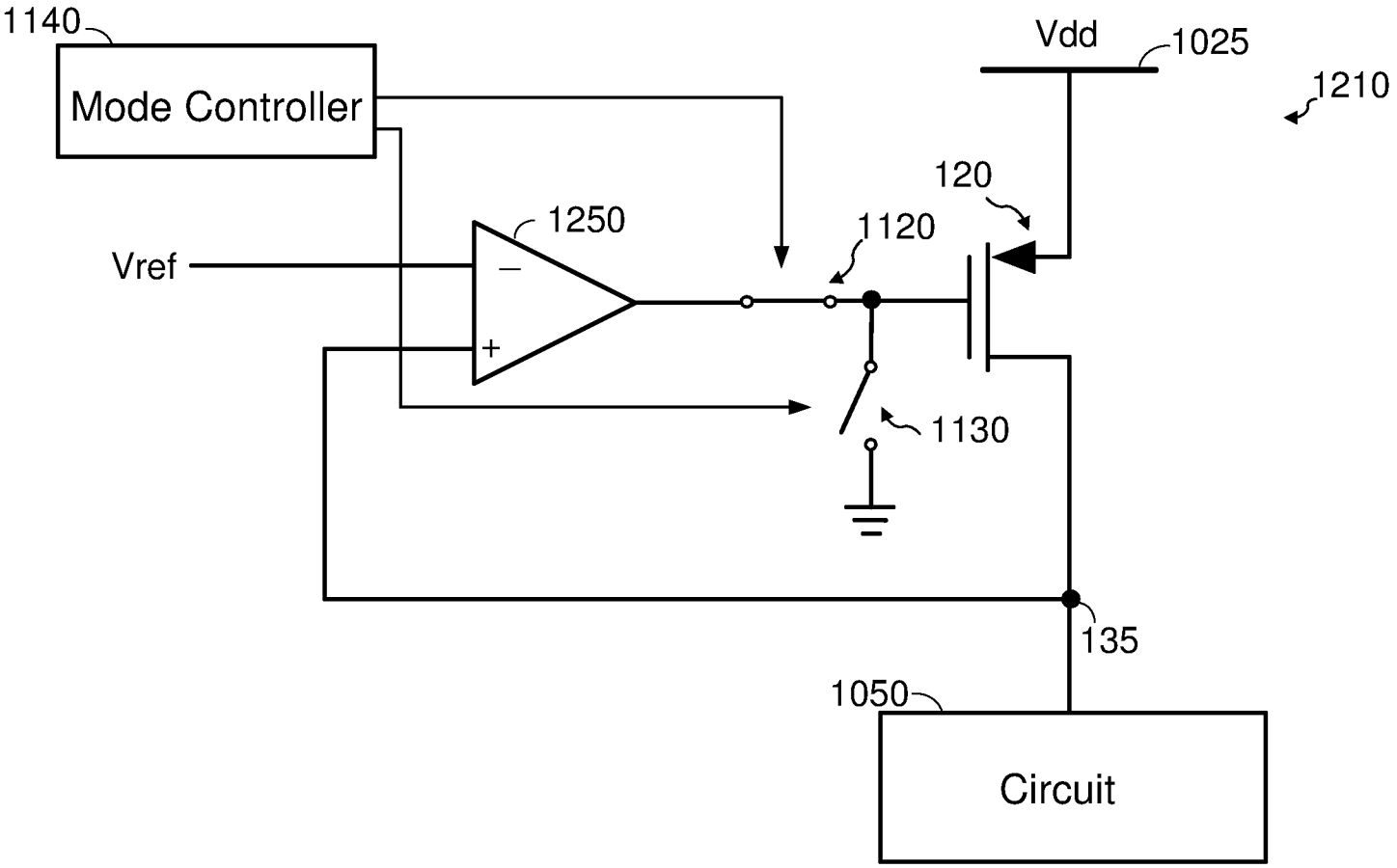
FIG. 12 shows an example of an LDO regulator capable of being configured to operate as a power switch according to certain aspects of the present disclosure.

It is to be appreciated that the first and second switches 1120 and 1130 are not limited to the exemplary LDO regulator 1110 shown in FIGS. 11A and 11B, and may be used in other LDO regulator topologies to configure a pass transistor into a power switch in the power switch mode. In this regard, FIG. 12 shows an example of another LDO regulator 1210 that is capable of being configured to operate in a voltage-regulation mode or a power-switch mode. The LDO regulator 1210 includes the pass transistor 120, the mode controller 1140, the first switch 1120, and the second switch 1130 discussed above. In this example, the LDO regulator 1210 includes an error amplifier 1250 (e.g., operational amplifier), in which the positive input of the error amplifier 1250 is coupled to the output 135 via a feedback path, and the negative input of the amplifier 1250 is coupled to a reference voltage Vref. The first switch 1120 is between the output of the error amplifier 1250 and the gate of the pass transistor 120, and the second switch 1130 is between the gate of the pass transistor 120 and ground.

To operate the LDO regulator 1210 in the power-switch mode, the mode controller 1140 turns off the first switch 1120 and turns on the second switch 1130. In this mode, the pass transistor 120 provides a low resistance path between the supply rail 1025 and the circuit 1050, as discussed above. To operate the LDO regulator 1210 in the voltage-regulation mode, the mode controller 1140 turns on the first switch 1120 and turns off the second switch 1130. In this mode, the error amplifier 1250 adjusts the voltage at the gate of the pass transistor 120 to maintain the regulated voltage at approximately the reference voltage Vref. In certain aspects, the LDO regulator 1210 may include a voltage divider (not shown) in the feedback path, in which the regulated voltage Vreg at the output 135 is divided by the voltage divider before being fed back to the positive input of the error amplifier 1250.

In general, the first and second switches 1120 and 1130 may be use in other LDO regulator topologies in which the first switch 1120 is between the output of an amplifier and the gate of the pass transistor, and the second switch 1130 is between the gate of the pass transistor and ground. The input of the amplifier is coupled to output of the LDO regulator via a feedback path. In the example in FIGS. 11A and 11B, the transistor 130 is in the feedback path.

Figure 13:
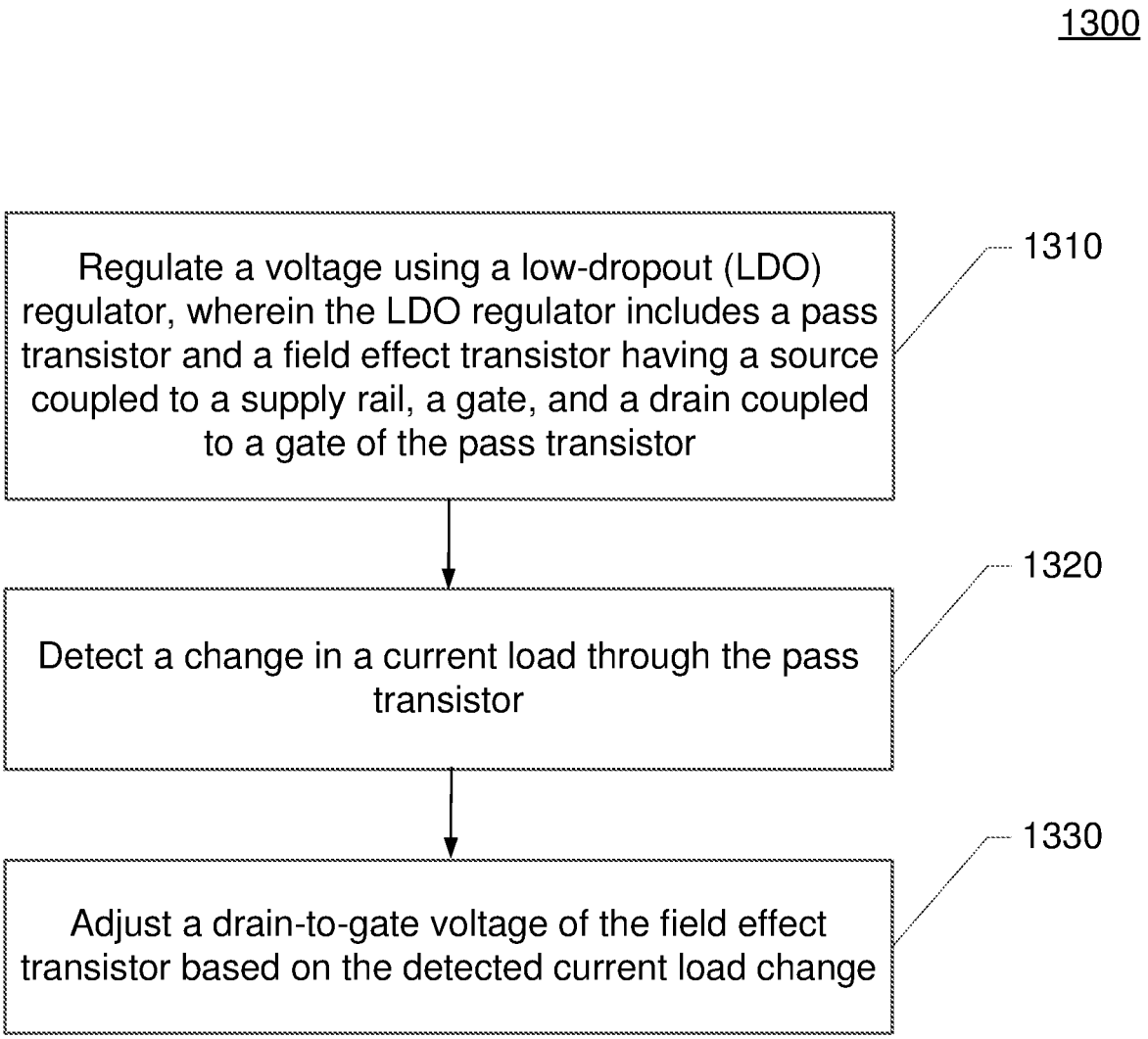
FIG. 13 is a flowchart showing a method of voltage regulation according to certain aspects of the present disclosure.

FIG. 13 is a flowchart illustrating a method 1300 of voltage regulation according to certain aspects of the present disclosure.

At block 1310, a voltage is regulated using a low-dropout (LDO) regulator, wherein the LDO regulator includes a pass transistor, and a field effect transistor having a source coupled to a supply rail, a gate, and a drain coupled to a gate of the pass transistor. The field effect transistor (e.g., FET 530) may be used as a load in a feedback loop of the LDO regulator and the pass transistor (e.g., pass transistor 120) may be used to deliver current to a circuit at a regulated voltage (e.g., Vreg).

At block 1320, a change in a current load through the pass transistor is detected. The change in the current load may be detected directly or indirectly. For example, the change in the current load may be detected indirectly by detecting a change in a voltage (e.g., source-to-gate voltage of the field effect transistor or pass transistor) affected by the current load.

At block 1330, a drain-to-gate voltage of the field effect transistor is adjusted based on the detected change in the current load. For example, the drain-to-gate voltage (e.g., $V_B$) may be adjusted in an opposite direction as a direction of a change in the source-to-gate voltage of the field effect transistor caused by the change in the current load. In another example, the drain-to-gate voltage (e.g., $V_B$) may be adjusted in a direction that reduces the sensitivity of the transconductance (e.g., $gm_D$) of the field effect transistor to the change in the current load.

The mode controller 1140, the regulation control circuit 140 and the voltage control circuit 525 discussed above may be implemented with a general-purpose processor, a digital signal processor (DSP), an application specific integrated circuit (ASIC), a field programmable gate array (FPGA) or other programmable logic device, discrete hardware components (e.g., logic gates), or any combination thereof designed to perform the functions described herein. A processor may perform the functions described herein by executing software comprising code for performing the functions. The software may be stored on a computer-readable storage medium, such as a RAM, a ROM, an EEPROM, an optical disk, and/or a magnetic disk.

It is to be understood that present disclosure is not limited to the terminology used above to describe aspects of the present disclosure. For example, it is to be appreciated that a power switch may also be referred to as a head switch, a bulk head switch, or another terminology. In another example, it is to be appreciated that the source-to-gate voltage of a transistor may also be referred to as the magnitude of the gate-to-source voltage of the transistor, which may be represented as $|V_{GS}|$.

Any reference to an element herein using a designation such as "first," "second," and so forth does not generally limit the quantity or order of those elements. Rather, these designations are used herein as a convenient way of distinguishing between two or more elements or instances of an element. Thus, a reference to first and second elements does not mean that only two elements can be employed, or that the first element must precede the second element.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect electrical coupling between two structures.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed is:

1. A load circuit of a low-dropout (LDO) regulator, comprising:

a field effect transistor having a source coupled to a supply rail, a gate, and a drain coupled to a gate of a pass transistor of the LDO regulator;

an adjustable voltage source coupled between the drain and the gate of the field effect transistor; and a voltage control circuit configured to detect a change in a current load through the pass transistor, and to adjust a voltage of the adjustable voltage source based on the detected change in the current load.

2. The load circuit of claim 1, wherein the voltage control circuit is configured to:

detect the change in the current load by detecting a change in a source-to-gate voltage of the field effect transistor caused by the change in the current load; and adjust the voltage of the adjustable voltage source in a direction that is opposite to a direction of the detected change in the source-to-gate voltage of the field effect transistor.

3. The load circuit of claim 1, wherein the voltage control circuit is configured to adjust the voltage of the adjustable voltage source in a direction that reduces a sensitivity of a transconductance of the field effect transistor to the change in the current load.

4. The load circuit of claim 1, wherein:

the LDO regulator includes an amplifier in a feedback loop of the LDO regulator; and the drain of the field effect transistor is coupled between an output of the amplifier and the gate of the pass transistor.

5. The load circuit of claim 4, wherein the amplifier comprises a common-gate amplifier.

6. The load circuit of claim 1, wherein the adjustable voltage source comprises:

a resistor coupled between the drain and the gate of the field effect transistor;

a first adjustable current source coupled to a first end of the resistor; and a second adjustable current source coupled to a second end of the resistor;

wherein the voltage control circuit is configured to adjust the voltage of the adjustable voltage source by adjusting a current of the first adjustable current source and a current of the second adjustable current source.

7. The load circuit of claim 6, wherein the voltage control circuit comprises:

a current source configured to generate a current; and a current sense transistor configured to generate a sense current that is proportional to a current through the field effect transistor;

wherein the voltage control circuit is configured to:

subtract the sense current from the current of the current source to generate a difference current; and adjust the current of the first adjustable current source and the current of the second adjustable current source based on the difference current.

8. The load circuit of claim 1, wherein a source of the pass transistor is coupled to the supply rail, and a drain of the pass transistor is coupled to an output of the LDO regulator.

9. The load circuit of claim 8, wherein the field effect transistor comprises a first p-type field effect transistor (PFET) and the pass transistor comprises a second PFET.

10. A method of voltage regulation, comprising:

regulating a voltage using a low-dropout (LDO) regulator, wherein the LDO regulator includes a pass transistor, an amplifier in a feedback loop of the LDO regulator, and a field effect transistor having a source coupled to a supply rail, a gate, and a drain coupled between an output of the amplifier and a gate of the pass transistor;

detecting a change in a current load through the pass transistor; and adjusting a drain-to-gate voltage of the field effect transistor based on the detected change in the current load.

11. The method of claim 10, wherein:

detecting the change in the current load comprises detecting a change in a source-to-gate voltage of the field effect transistor caused by the change in the current load; and adjusting the drain-to-gate voltage of the field effect transistor comprises adjusting the drain-to-gate voltage of the field effect transistor in a direction that is opposite to a direction of the detected change in the source-to-gate voltage of the field effect transistor.

12. The method of claim 10, wherein adjusting the drain-to-gate voltage of the field effect transistor comprises adjusting the drain-to-gate voltage of the field effect transistor in a direction that reduces a sensitivity of a transconductance of the field effect transistor to the change in the current load.

13. The method of claim 10, wherein the amplifier comprises a common-gate amplifier.

14. The method of claim 10, wherein a source of the pass transistor is coupled to the supply rail, and a drain of the pass transistor is coupled to an output of the LDO regulator.

15. The method of claim 10, wherein the field effect transistor comprises a first p-type field effect transistor (PFET) and the pass transistor comprises a second PFET.

16. A low-dropout (LDO) regulator, comprising:

a pass transistor having a source coupled to a supply rail, a gate, and a drain coupled to an output of the LDO regulator;

an amplifier having an output and an input, wherein the input of the amplifier is coupled to the output of the LDO regulator via a feedback path;

a first switch between the output of the amplifier and the gate of the pass transistor;

a second switch between the gate of the pass transistor and a ground; and a mode controller configured to:

operate the LDO regulator in a voltage-regulation mode by turning on the first switch and turning off the second switch; and operate the LDO regulator in a power-switch mode by turning off the first switch and turning on the second switch.

17. The LDO regulator of claim 16, further comprising:

a flipped source follower transistor in the feedback path, wherein the flipped source follower transistor has a source coupled to the output of the LDO regulator, a gate, and a drain coupled to the input of the amplifier; and wherein the flipped source follower transistor is configured to set a regulated voltage at the output of the LDO regulator based on a set voltage input to the gate of the flipped source follower transistor.

18. The LDO regulator of claim 17, further comprising a current source coupled between the drain of the flipped source follower transistor and the ground.

19. The LDO regulator of claim 16, wherein:

the input of the amplifier comprises a first input and a second input;

the first input is coupled to the output of the LDO regulator via the feedback path; and the second input is coupled to a reference voltage.

20. The LDO regulator of claim 16, wherein the mode controller is configured to:

receive a signal indicating one of multiple supply voltage levels, the multiple supply voltage levels including a first voltage level and a second voltage level;

operate the LDO regulator in the voltage-regulation mode if the signal indicates the first voltage level; and operate the LDO regulator in the power-switch mode if the signal indicates the second voltage level.

21. The LDO regulator of claim 20, wherein the second voltage level is below the first voltage level.

* * * * *